United States Patent [19]

Hiyoshi et al.

[11] 4,082,027

[45] Apr. 4, 1978

[54] ELECTRONICS MUSICAL INSTRUMENT

[75] Inventors: Teruo Hiyoshi; Akira Nakada; Shigeru Yamada, all of Hamamatsu; Kiyoshi Ichikawa, Hamakita; Shigeki Ishii, Hamamatsu, all of Japan

[73] Assignee: Nippon Gakki Seizo Kabushiki Kaisha, Hamamatsu, Japan

[21] Appl. No.: 678,709

[22] Filed: Apr. 20, 1976

[30] Foreign Application Priority Data

| | | |
|---|---|---|
| Apr. 23, 1975 | Japan | 50-49525 |
| Apr. 25, 1975 | Japan | 50-50559 |
| Apr. 26, 1975 | Japan | 50-51247 |

[51] Int. Cl.[2] ..... G10H 1/00

[52] U.S. Cl. ..... 84/1.01; 84/1.03; 84/1.19; 84/1.24

[58] Field of Search ..... 84/1.01, 1.03, 1.11, 84/1.12, 1.13, 1.19, 1.21–1.23, 1.24, 1.26, DIG. 7

[56] References Cited

U.S. PATENT DOCUMENTS

| | | | |
|---|---|---|---|
| 3,610,800 | 10/1971 | Deutsch | 84/1.01 |
| 3,801,721 | 4/1974 | Bunger | 84/1.19 |
| 3,821,714 | 6/1974 | Tomisawa et al. | 84/1.01 |
| 3,844,379 | 10/1974 | Tomisawa et al. | 84/1.01 |
| 3,854,365 | 12/1974 | Tomisawa et al. | 84/1.01 |
| 3,882,751 | 5/1975 | Tomisawa et al. | 84/1.01 |
| 3,902,396 | 9/1975 | Hiyoshi | 84/1.19 |
| 3,903,775 | 9/1975 | Kondo et al. | 84/1.01 |
| 3,939,750 | 2/1976 | Inoue et al. | 84/1.22 |
| 3,948,139 | 4/1976 | Melcher et al. | 84/1.19 |
| 3,979,989 | 9/1976 | Tomisawa et al. | 84/1.01 |
| 3,979,996 | 9/1976 | Tomisawa et al. | 84/1.25 |
| 3,981,217 | 9/1976 | Oya | 84/1.03 |
| 3,986,423 | 10/1976 | Rossum | 84/1.01 |

*Primary Examiner*—Robert K. Schaefer
*Assistant Examiner*—Vit W. Miska
*Attorney, Agent, or Firm*—Spensley, Horn & Lubitz

[57] ABSTRACT

In this electronic musical instrument, two separate tone generators of different type each produce a tone corresponding to an actuated key switch. Advantageously, one of the tone generators is of the Fourier synthesis type. In the other tone generator, a source waveshape having abundant harmonic components is processed by a tone color and volume control system which modifies the frequency spectrum and amplitude of the source waveshape in a time variant manner. The two generated tones are combined to produce the desired musical note.

Actuation of each key switch produces, in an assigned time slot, frequency information corresponding to the selected note, and designating the phase angle between successive sample points to be read from a waveshape memory. In the Fourier synthesis type generator, plural waveshape memories store harmonically related sinusoids, all of which are accessed simultaneously and weighted by harmonic coefficients to produce the first tone. In the other tone generator, a waveshape having abundant harmonics is read from a waveshape memory and is processed by that one of a plurality of tone color and volume control systems which is assigned to the corresponding time slot.

16 Claims, 20 Drawing Figures

TO WAVESHAPE MEMORY GROUP 13a
SR1
SR2
SR3
S/R (12/7) stages bits
S/R (12/7)
S/R (12/6)
Φ1
AD1
AD2
AD3
Cin
Cout
C1
C2
(Fa)
12a
MULTIPLICATOR
11a
Pa
FROM MEMORY 17
(F)
TO MALTPLICATOR
FREQUENCY INFORMATION MEMORY
10
F
AD
N1
N2
N3
N4
B1
B2
K1
K2

ELECTRONICS MUSICAL INSTRUMENT

BACKGROUND OF THE INVENTION

This invention relates to an electronic musical instrument and, more particularly, to an electronic musical instrument comprising a plurality of musical tone generator systems which are different from each other in the manner of producing musical tones and being capable of separately generating a musical tone designated by a key being depressed in the musical tone generator systems and simultaneously reproducing the musical tone from these different systems.

Various proposals have been made in the past for producing musical tones in an electronic musical instrument. These proposals include (1) a method for producing a musical tone by sequentially reading out, at a proper reading rate, a musical tone waveshape previously stored in a memory device, as sampled values of the waveshape (2) a method for producing a musical tone waveshape by multiplying amplitude values of respective harmonic components constituting a musical tone with sinusoidal signals having frequencies of the respective harmonic components and thereafter adding the results of such multiplication together and (3) a method for producing a musical tone by applying a tone source signal containing abundant harmonic components to a filter and attenuating predetermined harmonic components for obtaining a desired tone color.

Each of the proposed methods has its own merits and advantages but a desirable musical tone cannot be produced by applying one of such methods individually to an electronic musical instrument. A natural musical tone is a result of combination of various factors including complicated combinations of a large number of harmonic components and change of such combinations in relation to time. A musical tone to be obtained by one of the above described methods is insufficient when compared with a natural musical tone. The above described method (1), for example, requires a large number of waveshape memories since a single constant tone color only is stored in each of such waveshape memories. Besides, the methods (1) and (2) are disadvantageous because such methods can hardly produce change in the tone color (i.e. harmonic components) occurring with a lapse of time. Further, the method (3) has a limitation the extent of the harmonic components available for use and therefore is unable to produce complicated combination of a large number of harmonic components. For these reasons, a perfect simulation of a natural musical tone has not been realized by the above described methods.

There is a type of electronic musical instrument called a music synthesizer which is an application of the above described method (3). This type of musical instrument in which signals are all processed in an analog circuit has difficulties in maintaining an accurate pitch of the musical tone frequency and also in designing it in IC configuration. Besides, the musical synthesizer is incapable of simultaneously reproducing a plurality of musical tones so that its application is limited to a monotone musical instrument.

Characteristics of voltage-controlled type variable filter (hereinafter referred to as VCF) and a voltage-controlled type variable gain amplifier (hereinafter referred to as VCA) which are both used in the above described music synthesizer can be varied as desired by varying the cut-off frequency (in VCF) amplification gain (in VCA) in accordance with a control voltage. These VCF and VCA have therefore been utilized in other types of electronic musical instruments for controlling tone color and volume of a musical tone. Since it is desirable in electronic musical instruments that tone color and volume should vary with the lapse of time, a waveshape which changes with the lapse of time is generally used as a control voltage to be applied to these VCF an VCA. Accordingly, this control voltage waveshape determines variation in the tone color and an envelope of level change.

The prior art electronic musical instruments have produced such control voltage by utilizing charge and discharge waveshapes of a capacitor or by sequentially reading out levels at respective sample points of an envelope waveshape previously stored in a memory. The method of using a capacitor, however, defective in that the envelope waveshape cannot be changed as desired. The method of using a memory also has a problem that a large number of sample points is required for achieving satisfactory resolution of an envelope waveshape and, accordingly, a memory of large capacity is required with a resulting increase in the manufacturing cost.

SUMMARY OF THE INVENTION

It is, therefore, an object of the present invention to provide an electronic musical instrument capable of reproducing many kinds of musical tones with desired tone colors suited to various types of music.

It is another object of the invention to provide an electronic musical instrument which can be made very compact by employing an IC configuration.

It is another object of the invention to provide improvements in an electronic musical instrument capable of producing desired tone colors and controlling levels as desired by employing a VCF and a VCA.

It is still another object of the invention to provide an electronic musical instrument capable of producing a musical tone with an envelope of an excellent resolution whose shape can be changed as desired.

BRIEF DESCRIPTION OF THE DRAWINGS

FIG. 3 is a block diagram showing an example of a depressed key detection circuit;

FIG. 4 is a block diagram showing an example of a key assigner circuit;

FIG. 5 is a block diagram showing an example of a first musical tone generator;

FIG. 6 is a block diagram showing an example of a waveshape counter;

FIG. 7 is a block diagram showing an example of a harmonic coefficient memory;

FIG. 8 is a graphical diagram for explaining storage contents of a frequency information memory;

FIG. 9 is a block diagram showing an example of an envelope counter and a truncate counter in relation to relevant circuits connected thereto;

FIG. 10 is a block diagram showing an example of a second musical tone generator;

FIG. 11 is a circuit diagram showing an example of a footage changer;

FIG. 12 is a block diagram showing an example of a waveshape memory in relation to relevant circuits connected thereto;

FIG. 13 is a circuit diagram showing an example of a tone colour selection circuit;

FIG. 14 is a block diagram showing an example of a key assigner employed in the second musical tone generator;

FIG. 15 is a timing chart showing relationship between various clock pulses used in the circuit showin in FIG. 14;

FIG. 16 is a diagram for explaining operation of the circuit showin in FIG. 14;

FIG. 17 is a diagram for explaining symbols used in the logic circuit of the above embodiment;

FIG. 18 is a block diagram showing an example of an envelope generator provided for a voltage-controlled type filter;

FIG. 19 is a graphical diagram showing a typical pattern of an envelope waveshape produced by the envelope generator shown in FIG. 18; and FIG. 20 is a schematic block diagram showing an example of an envelope generator provided for a voltage-controlled type amplifier only with respect to its difference from the envelope generator showin in FIG. 18.

DESCRIPTION OF THE PREFERRED EMBODIMENT

Figure 1:
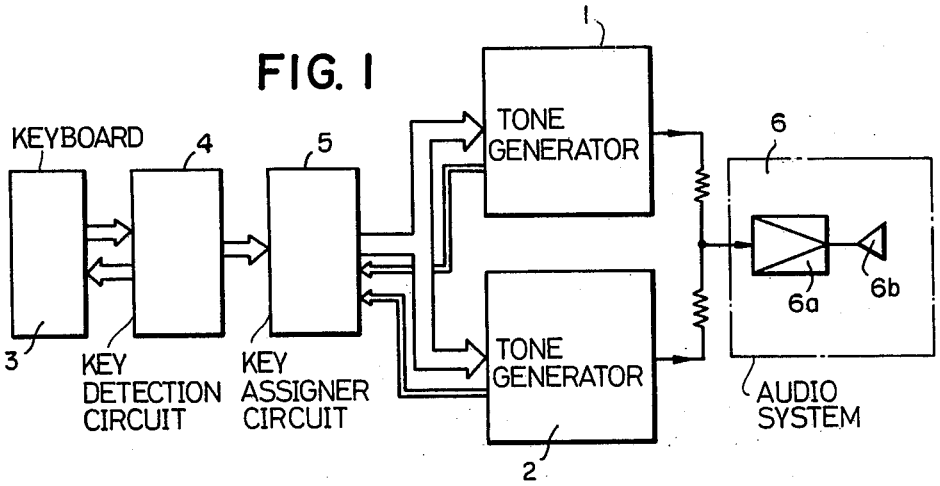
FIG. 1 is a schematic block diagram showing a preferred embodiment of the electronic musical instrument according to the invention.

FIG. 1 schematically shows a preferred embodiment of the electronic musical instrument according to the invention. This embodiment employs two kinds of musical tone generators 1 and 2 which are different from each other in the manner of producing the musical tone. A depressed key detection circuit 4 detects ON-OFF states of key switches of respective keys arranged on a keyboard 3 and thereupon produces an output for identifying the depressed key. A key assigner circuit 5 receives the information identifying the depressed key and assigns this information to one of channels corresponding in number to the maximum number of tones to be reproduced simultaneously (e.g. 12) for producing a key address code (i.e. coded representation of the key name) corresponding to the depressed key. The key assigner circuit 5 also produces other information including one representing whether a key is being depressed or has been released. The key information provided by the key assigner circuit 5 is simultaneously applied to the musical tone generators 1 and 2 and, in response thereto, the musical tones of the depressed key assigned to the corresponding channel are produced.

The first musical tone generator 1 generates sinusoidal signals of frequencies of respective harmonics constituting the musical tone in response to the key address code and synthesizes harmonic components of a desired combination by varying amplitudes of the harmonics of respective degrees as desired. The musical tone generator 1 therefore depends upon a system which may be termed a "harmonics synthesizing system". On the other hand, the second musical tone generator 2 generates a tone source waveshape containing an abundant harmonic content in response to the key address code and applies this tone source waveshape to a voltage-controlled type variable filter or a voltage-controlled type variable amplifier for producing a musical tone waveshape which changes in its tone color and volume as time elapses. In the second musical tone generator 2, the tone source waveshape is generated by driving a memory which previously stores, by chronologically sampled values, or waveshape containing predetermined harmonic components. Accordingly, various kinds of tone source waveshapes may be stored in different memories and a desired tone source waveshape may be read from such memories. The second musical tone generator 2 therefore depends upon a system which produces a musical tone by reading a single tone color waveshape from a single memory (a single waveshape reading system). In the generator 2, the tone source waveshape is applied to a filter for suitably attenuating the harmonic components and thereby producing a desired tone color. This may be conveniently termed a "filter system". Accordingly, the second musical tone generator 2 is a system which is a combination of the single waveshape reading system and the filter system. This combination can be realized by digitally producing information concerning the depressed key in the key assigner circuit, as will be described in detail later.

Musical tone signals of the respective channels are mixed in the first and the second musical tone generators and thereafter delivered therefrom. The outputs of the generators 1 and 2 are further mixed together and reproduced simultaneously from an audio system 6 (including an amplifier **6*a* and a speaker 6*b*). The outputs of the generators 1 and 2 may also be reproduced from different speakers or through an acoustic modulation device such as a rotary speaker. There are various means available for reproducing the outputs of the musical tone generators 1 and 2**.

Construction and operation of circuit portions constituting the electronic musical instrument will now be described in detail.

For achieving the purpose of reproducing plurality of musical tones simultaneously, the present embodiment has a construction based on dynamic logic so that the counters, logical circuits and memories provided therein are used in a time-sharing manner. Accordingly, time relations between clock pulses controlling the operations of these counters etc. are very important factors for the operation of the instrument of the present embodiment.

Figure 2:
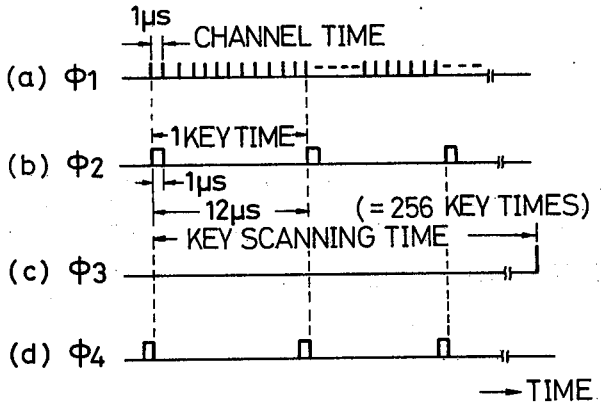
FIG. 2 is a timing chart showing relationship between various pulses used in the above embodiment.

Relations between the various clock pulses used in the present electronic musical instrument are illustrated in FIGS. 2(a) to 2(d). FIG. 2(a) shows a main clock pulse $\phi_1$ which has a pulse period of 1 $\mu$s. This pulse period is hereinafter referred to as a "channel time." FIG. 2(b) shows a clock pulse $\phi_2$ having a pulse width of 1 $\mu$s and a pulse period of 12 $\mu$s. This pulse period of 12 us is hereinafter referred to as "time". FIG. 2(c) shows a key scanning clock pulse $\phi_3$ which has a pulse period equivalent to 256 key time. 1 key time is divided by 1 $\mu$s into twelve and each fraction of the divided key time is called first, second . . . twelfth channel respectively. FIG. 2(d) shows a clock pulse $\phi_4$ which appears only during the twelfth channel in each key time. Each channel has its own time slot or a shared portion of time, i.e. the channel time.

DEPRESSED KEY DETECTION CIRCUIT

Figure 3:
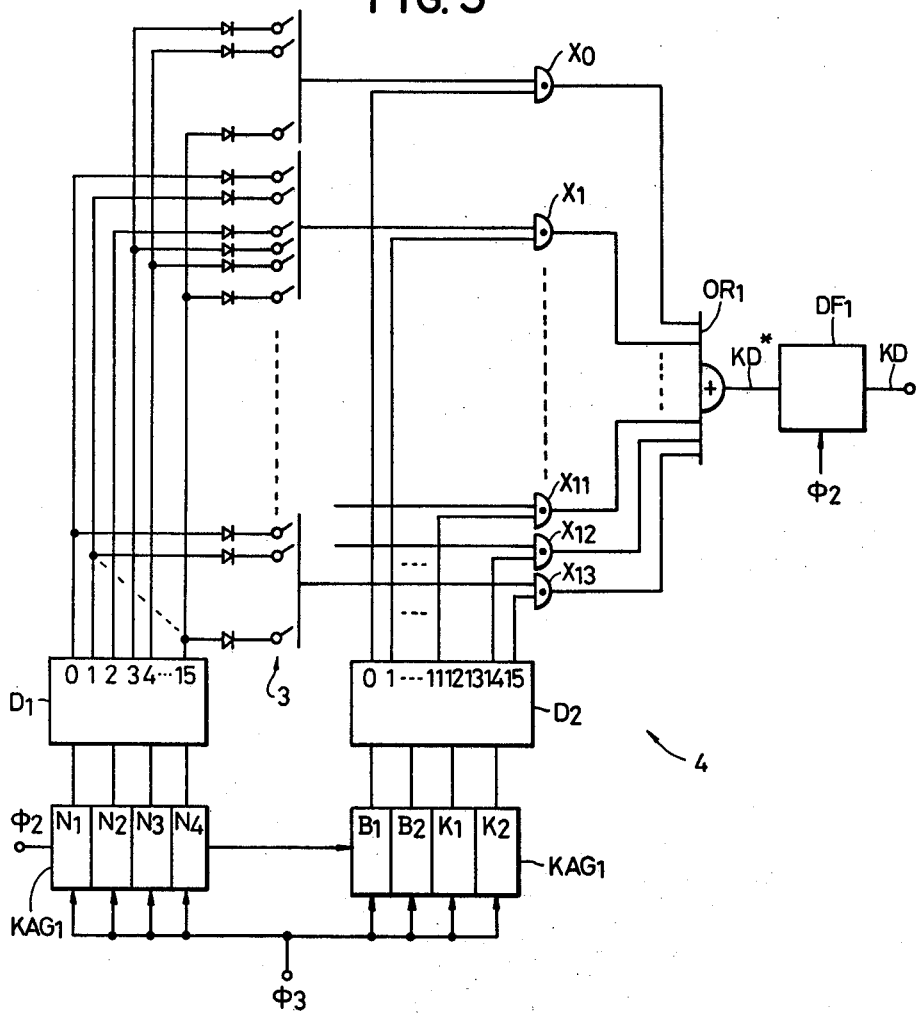
FIGS. 3 through 20 show component parts of the above embodiment in detail. More particularly.

Referring to FIG. 3, a depressed key detection circuit 4 sequentially scans and detects ON-OFF states of respective key switches of a keyboard 3. A binary counter $KAG_1$ consisting of eight stages sequentially counts the key clock pulse $\phi_2$ and is reset in synchronization with the key scanning clock $\phi_3$. There are 256 codes, i.e. combinations of logical values 1 and 0, each code corresponding to one of the keys. Digits of the key address code generator $KAG_1$ from the least significant digit up to the most significant digit are represented by reference characters $N_1$, $N_2$, $N_3$, $N_4$, $B_1$, $B_2$, $K_1$ and $K_2$ respectively. Among them, $K_2$, and $K_1$ constitute a keyboard, $B_2$ and $B_1$ a block code representing a block in the keyboard and $N_1$ through $N_4$ a note code representing a musical note in the block. Each keyboard is divided into four blocks each including 16 keys. These blocks are designated as block 1, block 2, block 3 and block 4 counting from the lowest note side.

Decoder $D_1$ is a 4-digit-binary to 16-individual decoder and is provided for decoding the codes of $N_1$–$N_4$ of the counter $KAG_1$ into 16 kinds of outputs. Each of output lines of the decoder $D_1$ is connected to a corresponding key switch of the keyboards 3. The output terminals of the respective key switches are commonly connected by each block and connected to corresponding AND circuits $X_0$–$X_{13}$.

Decoder $D_2$ is also a 4-digit-binary to 16-individual decoder and is provided for decoding the codes of $B_1$–$K_2$ of the counter $KAG_1$ into 16 kinds of outputs. Output lines (exept for Nos. 12 and 13) of the decoder $D_2$ corresponding to the respective blocks are connected to the AND circuits $X_0$–$X_{13}$. Thus, the ON-OFF states of the respective key switches are sequentially scanned and detected in response to the counting outputs of the counter $KAG_1$. The outputs of the AND circuits $X_0$–$X_{13}$ are combined by an OR circuit $OR_1$ to produce time-shared, multiplexed ON-OFF information of the respective keys. Time required for completing scanning of the 256 keys is $256 \times 12\ \mu s = 3.07$ ms. Each key has its own time slot having width of 12 $\mu$s, and when the output of the OR circuit $OR_1$ becomes "1", it signifies the fact that a key corresponding to the time slot is being depressed. The time-shared, multiplexed ON-OFF information of the respective keys delivered from the OR circuit $OR_1$ is hereinafter referred to as "key data signals". Key data signals KD* are delayed by 12 $\mu$s in a delay flip-flop $DF_1$ and becomes delayed key data signals KD.

Key assigner circuit

Figure 4:
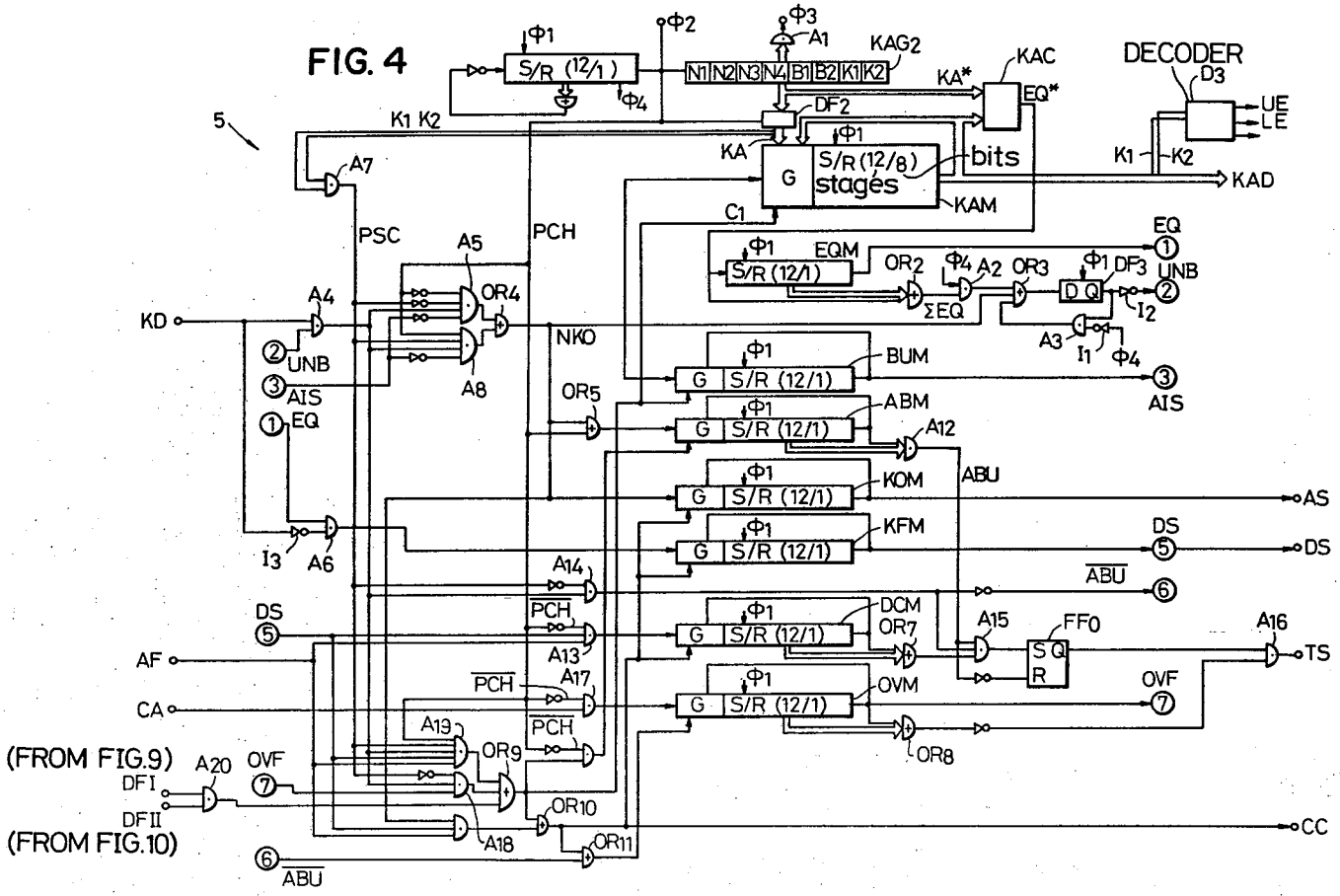

A key assigner circuit 5 shown in FIG. 4 is substantially the same as a key assigner disclosed in the U.S. Pat. No. 3,882,751 issued to Tomisawa et. al. on May 13, 1975.

A key address code generator $KAG_2$ is a binary counter consisting of eight stages and counting the key clock $\phi_2$. The key address code generator $KAG_2$ produces key address codes KA* ($N_1$, $N_2$, $N_3$, $N_4$, $B_1$, $B_2$, $K_1$, $K_2$). The fact that the respective bits of the key address code generator $KAG_2$ are all "1" is detected by an AND circuit $A_1$ and thereupon is produced a key scanning clock $\phi_3$, which is used to reset the counter $KAG_1$ in FIG. 3. Thus the key address code generator $KAG_1$ performs counting operation in synchronization with the key address code generator $KAG_2$. Accordingly, the key data signal KD* at a certain time point and a key address code KA* at that time point correspond to the same key switch.

A key address code memory KAM is capable of storing a key address code for each of channels corresponding in number to the maximum number of tones to be reproduced simultaneously. As the key address code memory, a suitable device such as a shift register of 12 stages (each stage consisting of 8 bits) is employed. This shift register sequentially shifts its contents upon receipt of the main clock $\phi_1$ and an output key address code KAD ($N_1$–$N_2$) of the final stage thereof is delivered to a post-stage circuit and also fed back to the input side thereof.

The key assigner circuit 5 causes a depressed key to be assigned to a certain channel in accordance with the key data signal KD and causes the key address code memory KAM to store a key address code KA (obtained by delaying the key address code KA* by 12 $\mu$s in a flip-flop $DF_2$) corresponding to the key data signal KD upon receipt thereof when the following two condition are satisfied:

Condition (A); The key address code KA is not identical with any of the codes KAD already stored in the key address code memory KAM. Condition (B); there is at least one empty (not-busy) channel, i.e. a channel in which no code is stored, in the key address code memory KAM.

The stored key address code is referred to as the key address signal KAD.

Assume now that a key data signal KD* which is a signal "1" is produced. While this signal is in a state of "1" which lasts for 12 $\mu$s, the key address code KA* from the key address code generator $KAG_2$ represents the note of the depressed key corresponding to the time slot of the key data signal. The key data signal KD* however, is delayed by 12 $\mu$s. During this 12 $\mu$s, the key address code KA* is applied to a comparison circuit KAC in which the code KA* is compared with each output of the channels of the key address code memory KAM. Alternatively stated, the key address code KA* is compared with every code in the memory KAM for detection of coincidence between the two. A coincidence signal EQ* produced from the comparison circuit KAC is "1" when there is coincidence and "0" when there is no coincidence. The coincidence signal EQ* is applied to a coincidence detection memory EQM and also to one input terminal of an OR circuit $OR_2$. This memory EQM is a shift register having a suitable number of stages, e.g. 12 as in this embodiment. The memory EQM successively shifts the signal EQ*, i.e. dalays it by one key time when the signal EQ* is "1" and thereby produces a coincidence signal EQ* (=1). Each of the outputs from the first to eleventh stages of the coincidence detection memory EQM is applied to the OR circuit $OR_2$. Accordingly, the OR circuit $OR_2$ produces an output when either the signal EQ* from the comparison circuit KAC or one of the outputs from the first to eleventh stages of the shift register EQM is "1". The output signal $\Sigma$EQ of the OR circuit $OR_2$ is applied to one of the input terminals of an AND circuit $A_2$. The AND circuit $A_2$ receives a clock pulse $\phi_4$ at the other input terminal thereof. Since information stored in the shift register before the first channel is false information, correct information, i.e. information representing the result of comparison between the key address code KA* and the codes in the respective channels of the key address code memory KAM is obtained only when the result of the comparison in each of the first to eleventh channels is applied to the coincidence memory EQM and the result of comparison in the twelfth channel is applied directly to the OR circuit $OR_2$. This is the reason why the clock pulse $\phi_4$ is applied to the AND circuit $A_2$.

If the signal $\Sigma$EQ is "1" when the clock pulse $\phi_4$ is applied, the AND circuit $A_2$ produces an output "1"

which is applied through an OR circuit $OR_3$ to a delay flip-flop $DF_3$. The signal is delayed by this delay flip-flop $DF_3$ by one channel time and fed back thereto via an AND circuit $A_3$. Thus, the signal "1" is stored during one key time until a next clock pulse $\phi_4$ is applied to the AND circuit $A_3$ through an inverter $I_1$. The output "1" of the delay flip-flop $DF_3$ is inverted by an inverter $I_2$ and is provided as an unblank signal. This unblank signal indicates that the same code as the key address code KA* is not stored in the key address code memory KAM when it is "1", and that the same code as the key address code KA* is stored in the memory KAM when it is "0".

As described in the foregoing, presence of the condition (A) is examined during production of the key data signal KD* and the unblank signal "1" is produced when the condition (A) is satisfied, whereas the unblank signal "0" is produced when this condition is not satisfied. The key data signal KD* is delayed by one key time and applied to one of the input terminals of an AND circuit $A_4$. In the meantime, the unblank signal UNB produced in the above described manner is applied to the other input terminal of the AND circuit $A_4$. Consequently, the key data signal KD is fed through the AND circuit $A_4$ to an AND circuit $A_5$ when the signal UNB is "1".

In order for a new key address code KA* to be stored in the key address code memory, KAM, one of the twelve channels of the memory must be in a not-busy state, i.e. available for storage. A busy memory BUM is provided to detect whether there is a not-busy channel in the key address code memory. The busy memory BUM consists of a shift register of 12 stages of 1 bit, and is adapted to store "1" when a new key-on signal to be described later is applied thereto from an OR circuit $OR_4$. This signal "1" is sequentially and cyclicly shifted in the busy memory BUM. This new key-on signal is simultaneously applied to the key address code memory KAM so as to cause the memory KAM to store the new key address code. Accordingly, the signal "1" is stored in one of the channels of the busy memory BUM corresponding to the busy channel of the key address code memory KAM. Contents of a not-busy channel are "0". Thus, the output of the final stage of the busy memory BUM indicates whether this channel is busy or not. This output is hereinafter referred to as a busy signal $A_1S$.

This busy signal $A_1S$ is applied to one of the input terminals of the AND circuit $A_5$ via an inverter. When a signal $A_1S$ is "0", i.e., a certain channel is not busy, the key data signal is applied to the busy memory BUM as the new key-on signal via the AND circuit $A_5$, thereby causing the busy memory BUM to store "1" in its corresponding channel. Simultaneously, the gate G of the key address code memory KAM is controlled so that the key address code KA from a delay flip-flop $DF_2$ will be stored in a not-busy channel of the memory KAM.

The delay flip-flop $DF_2$ is provided for delaying the output KA* of the key address code generator $KAG_2$ by one key time so that a key address code corresponding to the key data signal KD* may be stored in synchronization with the key data signal KD*, since the key data signal KD* is delayed by one key time.

The new key-on signal NKO from the OR circuit $OR_4$ is applied through the OR circuit $OR_3$ to the delay flip-flop $DF_3$ to set the flip-flop.

This arrangement is provided to ensure storage of the key address code KA in only one, and not two or more, not-busy channel of the key address code memory KAM.

In the above described operation, input signals $\overline{PCH}$ and $\overline{PSC}$ to the AND circuit $A_5$ are assumed to be "1" respectively for convenience of explanation. The input signals $\overline{PCH}$ and $\overline{PSC}$ will be described in detail later.

It will be understood from the foregoing description that the depressed key is assigned to the required channel, the key address code corresponding to the key is stored in the key address memory KAM and the key address signals KAD ($N_1$–$K_2$) are produced in time-sharing manner. These key address signals KAD are utilized for generation of musical tones having frequences of the corresponding keys. The information $K_1$, $K_2$ representing the kind of the keyboard which is irrelevant to the tone pitch is not directly used for generation of musical frequency tone signal but is decoded on output lines representing the upper, lower and pedal keyboards for various control purposes. When upper keyboard signal UE, lower keyboard signal LE and pedal keyboard signal PE respectively become "1", this signifies that the key representing by the key address signal KAD being produced at that time slot belongs to the keyboard represented by the keyboard signal (UE, LE or PE) which is "1".

The new key-on signal NKO is applied to a key-on memory KOM consisting of a 12-stage/1-bit shift register. The key-on memory KOM thereupon memorizes a signal "1" in a corresponding channel thereof. This signal "1" is circulated by each one key time and also delivered out in a time-sharing manner as an attack start signal AS which represents that the key has been depressed just now.

If a key has been depressed and the key address code for that key has been stored in the memory KAM, the output coincidence signal EQ of the corresponding channel of coincidence detection memory EQM is a signal "1" when the key data signal KD for the key is produced from the delay flip-flop $DF_1$. By applying this coincidence signal EQ to one of the inputs of the AND circuit $A_6$ and the key data signal $\overline{KD}$ to the other input thereof through an inverter $I_3$, the AND circuit $A_6$ gates out the signal "1" when the key has been released and the key data signal KD thereby has become a signal "0". This output signal of the AND circuit $A_6$ which represents release of the key is applied to a corresponding channel of a key-off memory KFM consisting of a 12-stage/1-bit shift register. This signal "1" is circulated every one key time and also delivered out in a time-sharing manner as a decay start signal DS representing release of the key.

The present embodiment is constructed in such a manner that one channel is always reserved for a pedal keyboard tone. Accordingly, the remaining eleven channels are used for manual tones of the upper and lower keyboards and the above described assignment operation is conducted among these eleven channels. Only one pedal tone, therefore, can be reproduced.

More specifically, the instrument is constructed in such a manner that information concerning the pedal tone is received in the first channel whereas information concerning tones other than the pedal tone (i.e. manual tones) is received in the second to twelfth channels and never in the first channel.

An AND circuit $A_7$ receives key address codes $K_2$ and $K_1$ from the key address codes KA provided by the delay flip-flop $DF_2$. When both of key address codes $K_2$ and $K_1$ are "1", this represents that the address code KA relates to a key of the pedal keyboard. Accordingly, the key data signal KD applied when a signal PSC from the AND circuit $A_7$ is "1" is identified to be the one for the pedal key. The clock pulse $\phi_2$ synchronizes with the first channel. Accordingly, if this clock pulse $\phi_2$ is used as a pedal channel signal PCH and, when the signal PCH is "1", the storage device, memories and counters are synchronized at the time corresponding to the first channel, i.e. the channel for the pedal keys.

The new key-on signal NKO is divided into a new key-on signal for the pedal keys and a new key-on signal for the manual keys. When each of the pedal channel signal PCH, pedal key signal PSC, output of the AND circuit $A_4$, a signal $\overline{A_1S}$ obtained by inverting the busy signal which are applied to an AND circuit $A_8$ is "1", the new key-on signal for the pedal keys produced from the AND circuit $A_8$ is applied to the key address code memory KAM and a corresponding key address code is stored in the first channel of the key address code memory KAM. Simultaneously, a signal "1" is stored in the first channel of the busy memory BUM. During the time corresponding to the second to twelfth channels, the pedal channel signal PCH is "0", so that no new key-on signal for the pedal keys is produced from the AND circuit $A_8$. Consequently, no key address code for the pedal keys is stored in the second to twelfth channels of the key address code memory KAM. Further, no key address code for the manual keys is stored in the first channel of the memory KAM during this time.

In addition to the above described signals KAD, UE, LE, PE, AS and DS, a truncate signal TS and a counter clear signal CC to be described later are produced from the key assigner circuit 5. These signals KAD to CC are information concerning the keys assigned to the respective channels and signals related to the same channel are produced in synchronization with each other. The key assigner circuit 5 also receives signals DFI, DFII, AF and CA fed back from the first and second musical tone generators 1 and 2 which are utilized for controlling generation and disappearance of the signals KAD to CC as will be described later.

The first musical tone generator

Figure 5:
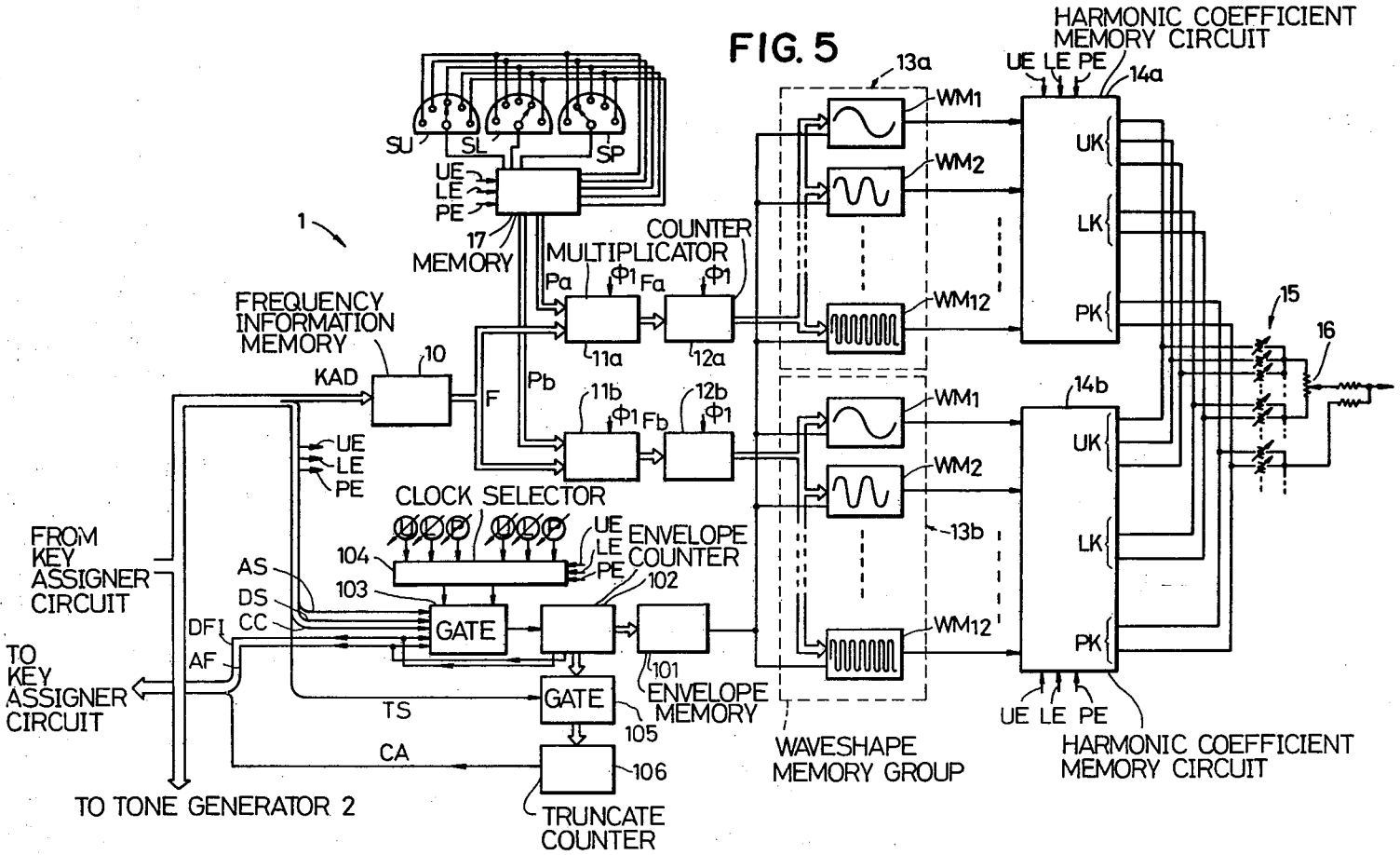

The first musical tone generator 1 shown in FIG. 5 receives the key address signal KAD, attack start signal AS, decay start signal DS, upper keyboard signal UE, lower keyboard signal LE, pedal keyboard signal PE, truncate start signal TS and counter clear signal CC provided respectively by the key assigner circuit 5. These signals are applied in time-shared fashion to the respective channels of the musical tone generator 1 and utilized for producing and stopping production of a musical tone. The musical tone generator 1 performs two functions, namely (1) generation of a musical tone waveshape and (2) envelope control of the musical tone.

(1) Generation of a musical tone waveshape.

Since the key address signal KAD designates a depressed key, numerical value information for musical tone frequency of the key designated by the key address signal KAD is read from a frequency information memory 10 in response to the key address signal KAD.

The frequency information memory 10 consisting of a suitable memory device such as a read-only memory previously stores frequency information corresponding to the key address codes of the respective keys and provides upon receipt of a certain key address signal KAD, frequency information corresponding to the key address code of the key. Since this frequency information is successively and cumulatively added with a regular time interval for periodically sampling amplitudes of a musical tone waveshape as will be described later, the frequency information is digital numerical value information related to the phase angle per unit time of the musical tone frequency. This numerical value of the frequency information is determined if the frequency of the musical tone and the sampling rate are determined.

Frequency information F read from the frequency information memory 10 is distributed to two systems and applied to multiplicators 11*a*, 11*b* of the respective system. The frequency information F is multiplied in these multiplicators 11*a*, 11*b* as will be described in detail later and thereafter is supplied to waveshape counters 12*a*, 12*b*.

The waveshape counters 12*a*, 12*b* cumulatively count frequency information Fa, Fb provided by the multiplicators 11*a*, 11*b* with a regular time interval. The results of the cumulative addition in the waveshape counters 12*a*, 12*b* are utilized as address signals for reading sampled waveshape amplitude values supplied from waveshape memory groups 13*a*, 13*b*. Accordingly, the phase angle of the read out waveshape proceeds by the cumulative counting.

Figure 6:
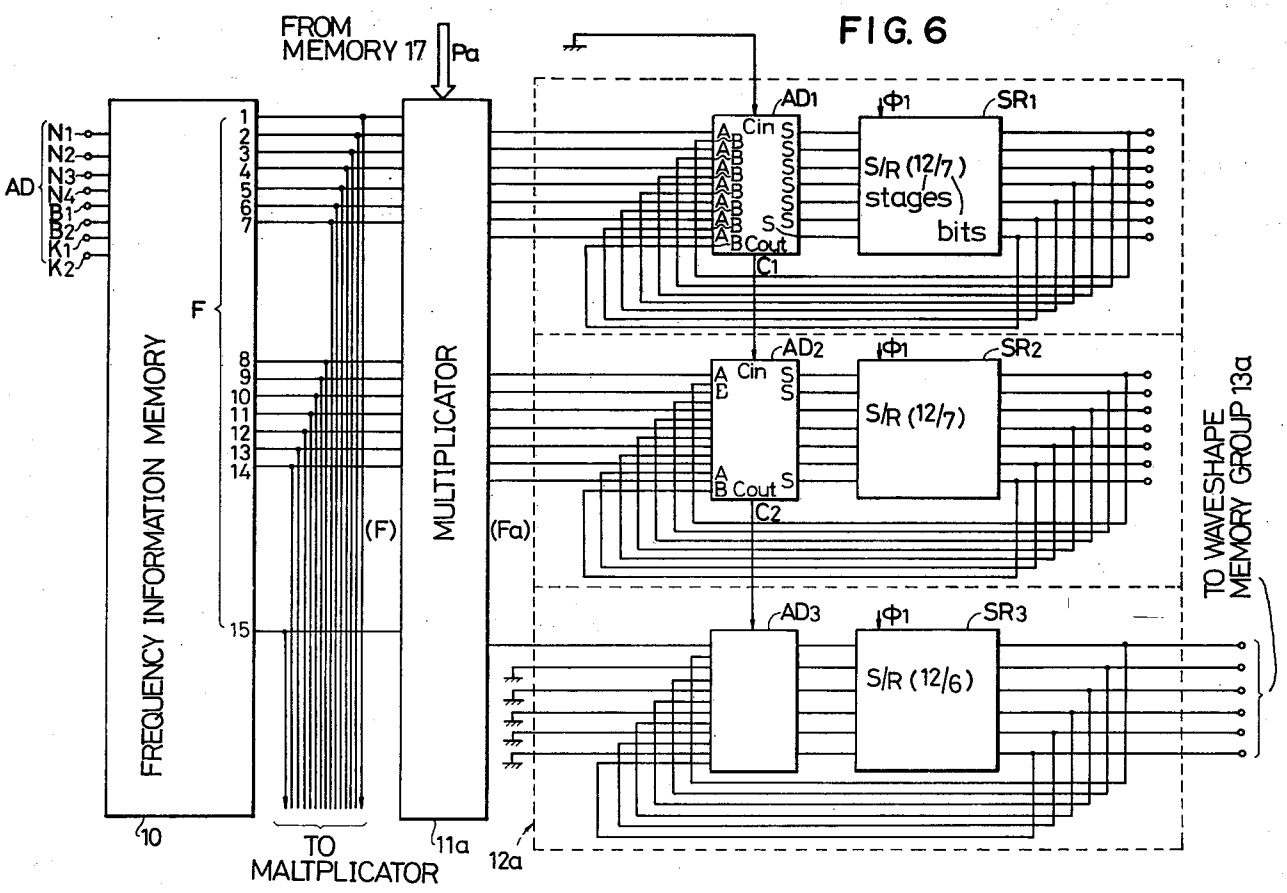

The present embodiment is constructed as shown in FIG. 6 for enabling the counters 12*a*, 12*b* to operate in time-shared fashion with respect to the respective channels. More specifically, input digits of three counters consisting of an adder $AD_1$ and a shift register $SR_1$, an adder $AD_2$ and a shift register $SR_2$ and an adder $AD_3$ and a shift register $SR_3$ are arranged so as to correspond to respective digits of frequency information F and carry signals $C_1$ and $C_2$ are applied from the counter of less significant digits to the counter of more significant digits. According to this arrangement, the frequency information Fa (or Fb) and the outputs of the shift registers $SR_1$–$SR_3$ are added together in the adders $AD_1$–$AD_3$ and results of the addtion are temporarily stored in the shift registers $SR_1$–$SR_3$. The shift registers have stages corresponding to the respective channels i.e. 12 stages, and perform cumulative addition in a time-sharing manner. The output of the counter for the most significant digit (i.e. the shift register $SR_3$) is supplied to a waveshape memory group 13*a* (and 13*b*) as the output of the waveshape counter 12*a* (and 12*b*).

The waveshape memory groups 13*a*, 13*b* respectively comprise a plurality of memories $WM_1$–$WM_{12}$ storing waveshapes whose frequencies are in the relation of harmonics relative to each other. More specifically, the waveshape memories $WM_1$–$WM_{12}$ respectively store mutually different sinusoidal waveshapes corresponding to 12 harmonic frequencies. For example, harmonics of the first (fundamental), second, third, fourth, fifth, sixth, seventh, eighth, tenth, twelfth, fourteenth and sixteenth degrees are stored in the waveshape memories $WM_1$–$WM_{12}$, one harmonic in one memory. These waveshape memories are constructed in such a manner that waveshape amplitude values at sample points corresponding to the digital address signals are read out in analog quantity. For example, the waveshape memories may be constructed so that amplitude value voltages at respective sample points of a waveshape are read out as desired by switching operation of electronic switching elements.

If the output of the waveshape counter 12*a* or 12*b* is information of 6 bits as shown in FIG. 6, 64 different address signals can be produced and, accordingly, the number of sample points in each of the memories $WM_1$–$WM_{12}$ is 64. Since the contents of the respective memories $WM_1$–$WM_{12}$ are read out simultaneously by means of the same address signal, the number of waveshape stored in the memories $WM_1$–$WM_{12}$ is not necessarily one (1 cycle) but a number equal to the degree of the harmonic. For example, the memory $WM_1$ stores one cycle of sinusoidal waveshape at 64 sample points and the memory $WM_{12}$ stores 16 cycles of sinusoidal waves at 64 sample points.

Accordingly, even though only one kind of output is produced from the waveshape counter 12*a* (or 12*b*), the waveshape memory group 13*a* (or 13*b*) produces 12 different kinds of sinusoidal wave signals, one frequency thereof being an interger multiple of another frequency. Alternatively stated, a plurality of harmonic frequencies are produced in parallel. Since these harmonic frequencies are of the same level, harmonic coefficient memory circuits 14*a*, 14*b* are provided for adjusting and mixing levels of respective harmonic frequencies and thereby producing a desired tone color.

Figure 7:
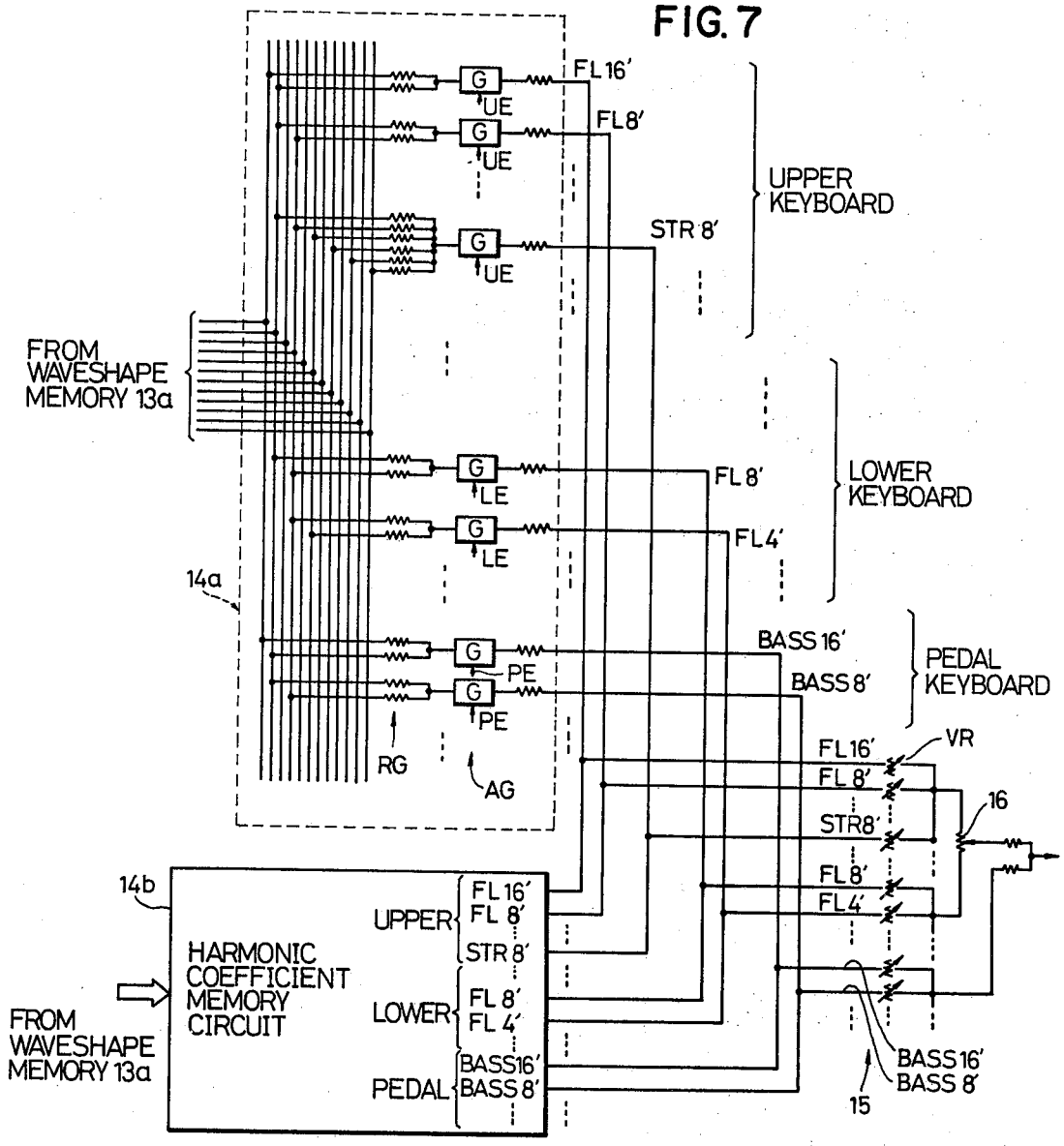

The first harmonic coefficient memory circuit 14*a* shown in FIG. 7 consists of a resistance mixing circuit and an analog gate circuit. The second harmonic coefficient memory circuit 14*b* is of the entirely same construction as the memory circuit 14*a*. The twelve kinds of harmonic frequency signals supplied from each of the waveshape memory groups 13*a*, 13*b* are resistance-mixed by a resistor group RG with a combination and at levels required for producing a desired tone color.

Resistor elements composing the resistor groups RG have mutually different registance values and coefficients of amplitude levels of the harmonic frequencies provided by the waveshape memories $WM_1$–$WM_{12}$ are determined by the respective registor elements. Sinusoidal signals having frequencies of respective harmonic degrees required for producing a signal of a desired tone color are supplied to the registor elements setting relative amplitude levels of the required harmonic components are mixed tone color by tone color. The mixed tone signals are thereafter applied to an analog gate circuit AG. Accordingly, a resistance mixing circuit is made up of the resistor group RG with respect to each of tones to be reproduced by the first musical tone generator 1 and the output of the resistance-mixing circuit is applied to the analog gate circuit AG. The combinations of these resistance-mixing circuits and analog gate circuits are formed for each of the keyboards so that tone clor control can be made keyboard by keyboard. For example, various tone colors (4' flute FL4', 8' flute FL8', 16' flute FL16', 8' strings STR8' ect.) can be generated with respect to each of the upper and lower keyboards. As for the pedal keyboard, various tone colors such as 8' bass BASS 8' and 16' BASS 16' can also be produced.

The upper keyboard signal UE, lower keyboard signal LE and pedal keyboard signal PE provided by the key assigner circuit 5 are respectively applied to the gate control input terminals of the gate circuits AG for the corresponding keyboards to enable these gate circuits AG. Since the key address signals KAD are produced in complete synchronization with the signals UE-PE, a keyboard to which a key corresponding to signals read from the waveshape memories 13*a*, 13*b* during a certain channel time belongs coincides with a keyboard represented by either one of the signals UE, LE and PE which enables the gate circuit AG during that time. Accordingly, all the musical tone waveshapes of tone colors available for production in a keyboard to which the key being depressed belongs are simultaneously produced from the harmonic coefficient memory circuits 14*a* and 14*b*. At that time no tone colors of the other keyboards are produced.

The same kind of tone color is produced from each of the first and second harmonic coefficient memory circuits 14*a* and 14*b*. The output tone color signals are mixed by each tone color and are applied to a tone color selector 15 of a corresponding keyboard. In other words, musical tone waveshapes of two systems are mixed together and supplied to the tone color selector 15. The tone color selector 15 selectively mixes the tone color by operation of the variable resistor element VR with respect to each of the tone colors available for production in each of the keyboards. Accordingly, the variable resistor elements VR are provided in correspondence to the respective outputs of the harmonic coefficient memory circuit 14*a* (or 14*b*). The outputs of the variable resistor elements VR (i.e. tone color selector 15) are combined keyboard by keyboard. The outputs of the upper keyboard and the lower keyboard are balance controlled in volume by a balance control variable resistor 16 and thereafter are mixed with the output of the pedal keyboard. This mixed output constitutes an output musical tone signal of the first musical tone generator 1.

As described in the foregoing, the first musical tone generator 1 combines a set of harmonics at selected relative amplitude levels to produce a single musical tone. This arrangement enables synthesizing of complicated harmonic components and, accordingly, production of various tone colors.

According to the present invention, there are provided two musical tone waveshape generation systems each comprising the multiplicator 11*a* (11*b*), waveshape counter 12*a* (12*b*), waveshape memory group 13*a* (13*b*) harmonic coefficient memory circuit 14*a* (14*b*) for mixing two tones which are only slightly different in pitch from each other and thereby producing beat to obtain a musical tone which is a close simulation of a natural musical tone. More specifically, the frequency information F read from the frequency information memory 10 is multiplied with different numerical values in the multiplicators 11*a*, 11*b* for producing difference between the frequency information Fa and Fb of the two systems and thereby producing pitch difference in the obtained musical tones.

Pitch difference designation values Pa, Pb are read from a pitch difference memory 17 and applied to the multiplicators 11*a*, 11*b* as multiplier inputs thereof. The pitch difference memory 17 stores, separately for each system, numerical values corresponding to cent values ($= 1200 \log_2 R$ where R represents frequency ratio) which are to constitute the pitch differences. For setting the amount of pitch difference, the levers of pitch difference selection switches SU, SL and SP provided for the respective keyboards are set at desired cent values and values corresponding to these set cent values are read from the memory 17 in response to the signals from the selection switches SU, SL and SP. Cent values of the pitch difference are set keyboard by keyboard by the pitch difference selection switches SU, SL and SP and the cent value set by a selection switch of a required keyboard only is read out in response to the keyboard signal (UE, LE or PE) of the required keyboard. For this purpose, each of the keyboard signals UE-PE is applied to a common terminal of a corresponding one of the switches SU-SP. Since only one keyboard signal (i.e. one of the keyboard signals UE-PE) is produced at a certain time point, a signal corresponding to a set value of a switch (one of SU-SP) corresponding to the keyboard signal is applied to the memory 17. Each of the switches SU-SP is so constructed that five kinds of cent values, i.e. 0 cent, 1 cent, 3 cents, 6 cents and 10 cents, can be set, each of these cent values representing amount of difference between the pitch in each of the two systems and a pitch in an equally termpered scale. In one of the two systems (e.g. the system comprising the multiplicator 11*a*), the pitch is higher than the pitch in the equally tempered scale, whereas in the other system (e.g. the system comprising the multiplicator 11*b*) the pitch is lower than the pitch in the equally tempered scale. Accordingly, if pitch difference of 10 cents is set in the switches SU-SP, pitch difference of +10 cents is produced in the former system and pitch difference of −10 cents is produced in the latter system, so that total pitch difference of 20 cents is produced by the two systems.

Figure 8:
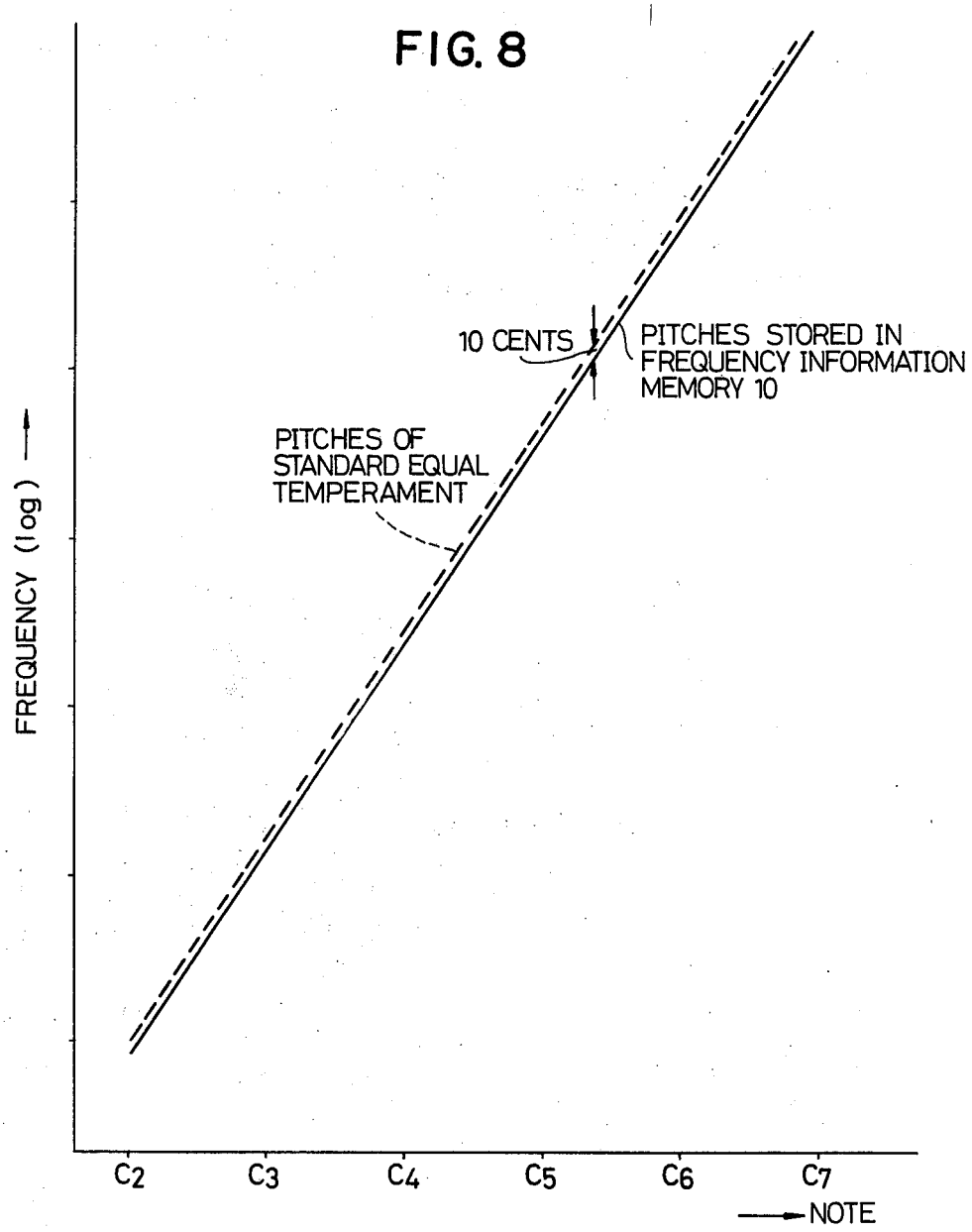

For simplifying the construction of the multiplicators 11*a*, 11*b*, 1 and a number more than 1 (in decimal notation) are used as the pitch difference designation values Pa, Pb to be read from the memory 17. Accordingly, frequency information F of a pitch which is lower than the equally tempered pitch by 10 cents, and not the equally tempered pitch, is stored in the frequency information memory 10 as shown in FIG. 8. Relations between set positions of the switches SU-SP and the contents stored in the memory 7 are illustrated, by way of example, in the following Table 1;

Table 1

| Set positions of switches SU-SP | Pitch difference from equally tempered pitch | Pitch difference from frequency information F | Pitch difference designation value stored in memory17 |
|---|---|---|---|
| 10 cents | +10 cents | +20 cents | 1.011618287 |
| 6 | +6 | +16 | 1.009283881 |
| 3 | +3 | +13 | 1.007536612 Pa |
| 1 | +1 | +11 | 1.006373447 |
| 0 | 0 | +10 | 1.005792941 |
| 1 | −1 | +9 | 1.005211624 |
| 3 | −3 | +7 | 1.004051143 Pb |
| 6 | −6 | +4 | 1.002312933 |
| 10 | −10 | 0 | 1.000000000 |

As will be apparent from the above Table 1, the numerical values used as the pitch difference designation value Pa for one of systems are designed to produce pitches which are higher than the equally tempered pitch, wheras the pitch difference designation value Pb for the other system are designed to produce pitches which are lower than the equally tempered pitch. The two values Pa, Pb are simultaneously read out. Although the pitch difference designation values are expressed in decimal notation in Table 1, these values are stored in binary notation in the memory 17. If 0 cent is designated, the designation values Pa and Pb are equivalent to each other and no pitch difference is produced between the two tones. The tones in this case are of an exact equally tempered pitch.

If the foregoing manner, a musical tone with a desired beat effect is produced by the tones of the two systems. Further, since the harmonics of the musical tone are in an exact integer multiple relationship, a musical tone of pure temperament can be produced and this also gives variety to the reproduced musical tone.

(2) Envelope control of the musical tone

An envelope which is a change occuring with lapse of time in the entire level of a musical tone waveshape formed in the above described manner is controlled by reading out an envelope waveshape stored in an envelope memory 101 by means of the output of an envelope counter 102. When the attack start signal AS or the decay start signal DM has been provided by the key assigner circuit 5, a select gate 103 selects an attack clock pulse or a decay clock pulse and the selected pulse is used for driving the counter 102.

Figure 9:
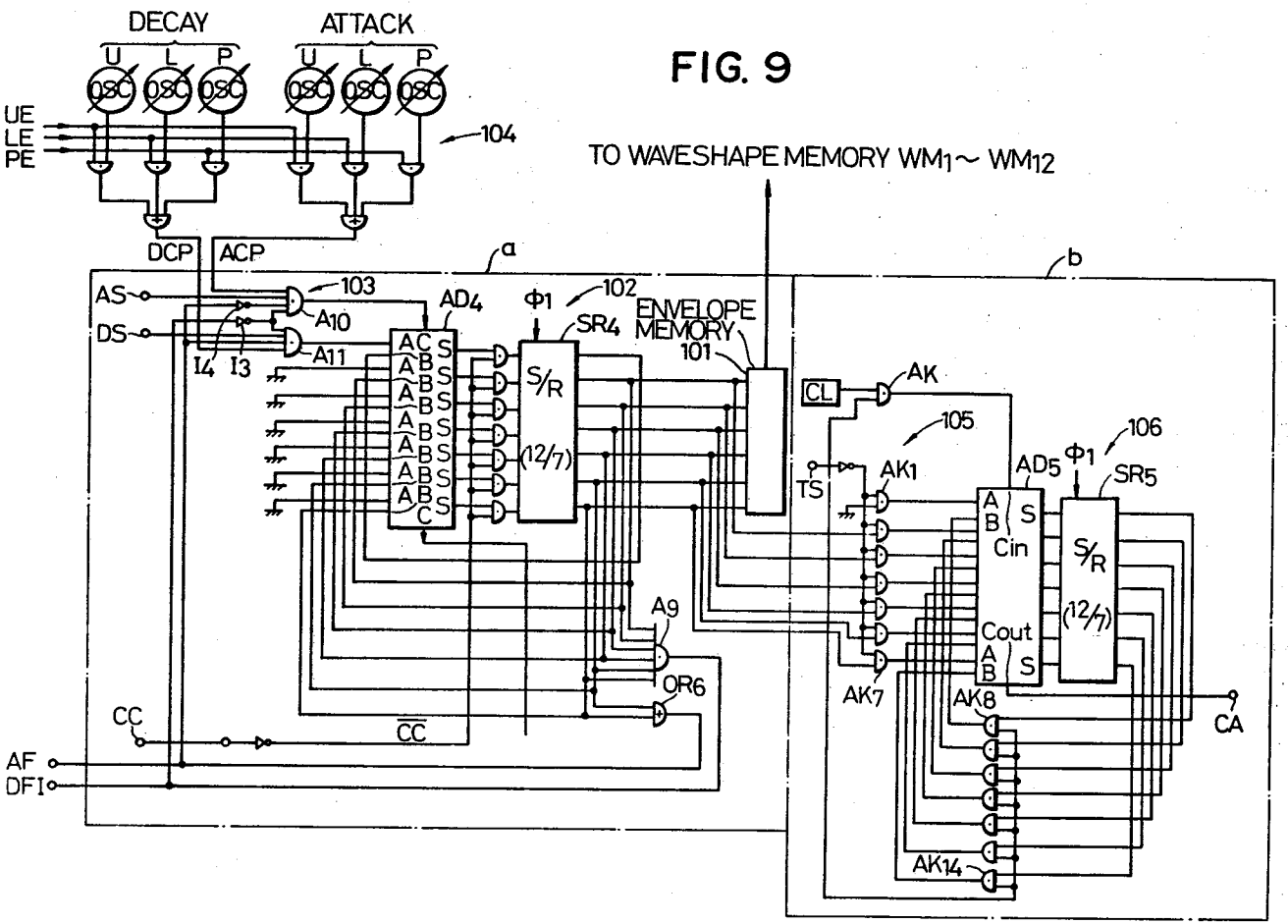

The circuit portion *a* shown by a chain line in FIG. 9 illustrates one example of an envelope generator. The envelope counter 102 comprises an adder $AD_4$ and a 12-stage 7-bit shift register $SR_4$, the result of addition in the adder $AD_4$ being supplied every 1 key time to corresponding channels of the shift registers $SR_4$. More specifically, the adder $AD_4$ adds the output of the shift register $SR_4$ and the attack or decay pulse and provides the result of the addition to the input terminal of the shift register $SR_4$ thereby causing the envelope counter to successively perform a cumulative counting with respect to each of the channels.

An output representing a counted value is applied from this envelope counter to an envelope memory 101 and a waveshape amplitude stored at an address corresponding to the counted value is successively read from this memory 101. The envelope memory 101 stores an attack waveform at addresses starting from 0 to a predetermined address, e.g. 16, and a decay waveform at addresses from the next address to the last one, e.g. 63.

The counting operation of the envelope counter will now be described with respect to the first channel assuming that the counted value of the first channel initially is "0".

When the attack start signal AS is applied to the select gate 103, an AND circuit $A_{10}$ which has already received signals "1" obtained by inverting outputs "0" of an AND circuit $A_9$ and an OR circuit $OR_6$ respectively by inverters $I_3$ and $I_4$ gates out an attack clock pulse ACP to the adder $AD_4$. The adder $AD_4$ and the shift register $SR_4$ successively count the attack clock pulses ACP thereby reading out the attack waveshape of the envelope memory 101. When the counted value has reached 16, an output "1" is produced from the OR circuit $OR_6$ and, accordingly, the attack clock pulse ACP ceases to pass through the AND circuit $A_{10}$. The attack clock puse ACP remains prevented from passing the AND circuit $A_{10}$ with respect to subsequent counts. Consequently, counting is once stopped and the amplitude stored at address No. 16 of the envelope memory 101 continues to be read out. Thus, a sustain state is maintained.

In this state, an AND circuit $A_{11}$ receives a signal "1" from the OR circuit $OR_6$ and also a signal "1" which is obtained by inverting the output "0" of the AND ciurcuit $A_9$ by the inverter $I_3$. When the decay start signal DS is applied to the select gate 103, a decay clock pulse DCP passes through the AND circuit $A_{11}$ and is applied to the adder $AD_4$. This causes the envelope counter to resume the counting operation for counted values after 16 and the decay waveshape is read from the envelope memory 101. When the counted value has reached 63, all of the inputs to the AND circuit $A_9$ become "1" so that the AND circuit $A_9$ produces an output "1". Accordingly, the AND circuit $A_{11}$ ceases to gate out the decay clock pulse DCP and the counting operation is stopped. Thus, the reading of the envelope waveshape has been completed.

In the above example, the decay start signal DS is applied at a counted value after 16. In a case wherein the decay start signal is applied before reading of the attack waveshape is completed, i.e. when the key is released immediately after depression thereof, the AND circuit $A_{11}$ does not pass the decay clock pulse DCP because the output "0" from the OR circuit $OR_6$ is applied to the AND circuit $A_{11}$. The decay waveshape therefore is never read out before the reading of the attack waveshape is completed, but is read out immediately upon completion of the reading of the attack waveshape.

The output of the OR circuit $OR_6$ is applied to the key assigner circuit 5 as a signal AF representing finishing of attack, whereas the output of the AND circuit $A_9$ is applied to the key assigner circuit 5 as a signal DFI representing finishing of decay.

The attack clock pulse ACP and the decay clock pulse DCP are respectively generated by different oscillators provided separately for each of the upper, lower and pedal key boards. These clock pulses generated with respect to each of the keyboards are selected by a clock selector 104 in response to the kind of the keyboard signal (UE, LE or PE) and thereafter is applied to the select gate 103. This arrangement enables adjustment of the attack or decay time.

The envelope memory 101 is constructed in such a manner that analog amplitude voltages at respective sample points of the envelope waveshape are read out in response to digital address inputs resulting in production of an analog envelope waveshape. This envelope waveshape is supplied to the respective waveshape memories $WM_1$–$WM_{12}$ of the waveshape memory groups 13*a*, 13*b* where it is used as power source voltage in the circuit for generating waveshape sample point amplitude voltages. Accordingly, the power source voltage in the circuit for generating the waveshape sample point amplitude voltages in each of the memories $WM_1$–$WM_{12}$ changes in accordance with change in the level of the envelope waveshape (i.e. change in the envelope) with a resultant change in the sample point amplitude voltage of the musical tone waveshape read from each of the memories $WM_1$–$WM_{12}$. If, for example, no envelope waveshape is read from the envelope memory 101, the power source voltage at the waveshape memories $WM_1$–$WM_{12}$ is 0 so that no musical tone waveshape is read out. In the above described manner, waveshape amplitude values are read from the memories $WM_1$–$WM_{12}$ at levels corresponding to the envelope waveshape whereby the envelope control of the musical tone waveshape is performed.

The above described musical tone waveshape forming and envelope control operations are performed synchronously in time-shared manner with respect to each of the channels.

Truncate Control Operation

According to the present electronic musical instrument, if a thirteenth key is depressed while all of the notes assigned to the channel(twelve notes) are being reproduced, one of the twelve notes which has attenuated, i,e, decayed or fallen in level, to the furthest degree is detected and the sounding of this detected note is stopped in order to reproduce the thirteenth note. This control operation is hereinafter called "trancate control operation".

The truncate control operation can be effected if and when the following conditions are satisfied:

(1) All of the twelve notes are being reproduced, (2) at least one of the notes is allenuating, and (3) the thirteenth key is depressed.

In order to examine whether condition (1) is satisfied or not, a new key-on signal from the OR circuit $OR_4$ (FIG. 4) is applied through the OR circuit $OR_5$ to an all-busy memory ABM and stored therein. While all of the twelve notes are being played, all of the channels of the all-busy memory ABM are "1". An AND circuit $A_{12}$ receives all of the bit outputs of the all-busy memory ABM and produces an all-busy signal ABU as its output. This signal ABU indicates that at least one of the channels is not-busy when it is "0" and that all of the channels are busy when it is "1".

As to condition (2), the output DS of the key-off memory KFM is applied to one of the inputs of an AND circuit $A_{13}$, for the key-off memory KFM stores "1" in either one of its channels corresponding to the channel which is in a key-off state. The AND circuit $A_{13}$ receives at the other input terminal thereof the attack finish signal AF from the envelope counter. When the signals DS and AF are both "1", this indicates that the sound of this channel is attenuating. The signal AF is applied to the AND circuit $A_{13}$ for producing the decay state after finishing of the attack state.

When one of the channels is in decay, the output "1" of the AND circuit $A_{13}$ is applied to a decay memory DCM and stored therein. The storage of "1" in either one of the channels of the decay memory DCM causes an OR circuit $OR_7$ to produce an output "1", thereby enabling detection of the condition (2). This output is hereinafter called "any decay signal".

An explanation will now be given regarding to detection of condition (3). When the thirteenth key is depressed, the key data signal KD is applied to one of the inputs of the AND circuit $A_4$. In the meantime, the unblank signal applied to the other input terminal of the AND circuit $A_4$ is "1" because the key data signal KD applied to the AND circuit $A_4$ is a key data signal corresponding to a new key address code which is not stored in the key address memory. Accordingly, the AND circuit $A_4$ produces a new key data signal "1". This signal "1" is applied through an AND circuit $A_{14}$ to an AND circuit $A_{15}$. This output represents the depression of the thirteenth key.

When conditions (1), (2) and (3) are all satisfied in the foregoing manner, all of the inputs to the AND circuit $A_{15}$ become "1" and thereby cause the AND circuit $A_{15}$ to produce an output "1" which is applied to a flip-flop $FF_0$ to set it. The set output of the flip-flop $FF_1$ is provided to a terminal TS via an AND circuit $A_{16}$ as a truncate start signal TS.

According to the present invention, when a new manual key is depressed while eleven manual tones are reproduced, reproduction of the manual tone which has attenuated to the furthest degree is cut short and a reproduction of the new manual tone is started. This is the truncate operation for the manual keys. As to the pedal tones, no two or more pedal tones are reproduced at the same time. Accordingly, when a new pedal key is depressed while another pedal tone is reproduced, the old pedal tone may be cancelled and the new pedal tone played only if the old pedal tone is attenuating.

The truncate operation for the manual tones will first be described. Detection of an all-busy state for this purpose is related to detection of reproduction of tones in the second to twelfth channels. However, the AND circuit $A_{12}$ receives outputs of all stages of the all-busy memory ABM and, accordingly, an all-busy state is not detected if a pedal tone is not being reproduced. The memory ABM is therefore constructed to store "1" in its first channel regardless of reproduction of a pedal tone. This is done by causing the pedal channel signal PCH to be stored in the first channel of the memory ABM via the OR circuit $OR_5$ when the signal PCH is "1".

The AND circuit $A_{15}$ receives at one of its inputs signals concerning the manual keyboards only. This is made possible by constructing the circuit so that the AND circuit $A_{14}$ receives a new key data signal from the AND circuit $A_4$ at one of its inputs and the signal $\overline{PSC}$ at the other input thereof. If the output of the AND circuit $A_4$ is one for a pedal tone, the AND circuit $A_{14}$ does not pass it, whereas if the signal is one for a manual keyboard, it is gated out of the AND circuit $A_{14}$ and applied to the AND circuit $A_{15}$.

The decay memory DCM is constructed not to store a signal "1" which represents a decaying state in its first channel when a decaying tone is a pedal tone. More specifically, since the signal $\overline{PCH}$ is applied to one of the inputs of the AND circuit $A_{13}$, it is only when one of the manual tones is decaying that a signal "1" is produced from the OR circuit $OR_7$.

The truncate start signal TS is applied to a truncate gate 10 of the first musical tone generator 1. In the truncate gate 105 and a truncate counter shown as the circuit portion *b* in FIG. 9, counting countents of each channel of the envelope counter 102 are sequentially transmitted to each channel of a 12-stage/7-bit shift register $SR_5$ and stored therein. When the above described signal TS is applied, AND gates $AK_1$–$AK_7$ are closed and AND gates $AK_8$–$AK_{14}$ are opened thereby forming a feed back loop. Accordingly, the truncate counter is separated from the envelope counter 102 and the counting in each channel is accelerated by applying a high rate clock pulse CL through AND circuit $A_k$ to the adder $AD_5$.

If the note of a certain channel has attenuated to the furthest degree, the corresponding channel of the truncate counter produces a carry signal CA.

This signal CA is stored in a corresponding channel of an overflow memory OVM in the key assigner circuit 5 through an AND circuit $A_{17}$ (FIG. 4). This memory OVM consists of a 12-stage/1-bit shift register and the output from the last stage of the shift register is fed back to the input thereof. When the signal "1" is stored in any channel of the overflow memory OVM, the output from an OR circuit $OR_8$ becomes "1" because the OR circuit $OR_8$ receives all the bit outputs of the overflow memory OVM. This output "1" of the OR circuit $OR_8$ is a signal indicating that a carry, i.e. overflow, is produced in either one of the channels of the truncate counter and hereinafter is called "any overflow signal". This any overflow signal is inverted by an inverter and applied to an AND circuit $A_{16}$. This causes the AND circuit $A_{16}$ to produce an output "0" and thereby stops the accelerated counting operation of the truncate counter 106 (FIG. 9).

When the signal "1" is produced from the overflow memory OVM, this signal OVF is applied to one of the inputs of an AND circuit $A_{18}$. If the output of the AND circuit $A_4$ is applied to the other input of the AND circuit $A_{18}$ at this time, the AND circuit $A_{18}$ produces a signal "1". This signal "1" is applied to the key address signal memory KAM and the busy memory BUM via the OR circuit $OR_9$ and clears the contents of the corresponding channels in these memories. The signal "1" is also applied to the key-on memory KOM, the key-off memory KFM and the gate G of the decay memory DCM via the OR circuit $OR_{10}$ and clears the contents of the corresponding channels of these memories. Further, the signal "1" is applied to the overflow memory OVM via the OR circuit $OR_{11}$ and clears the contents of the corresponding channel of this memory. Thus, the sounding of this channel is stopped and the new thirteenth note (actually the twelfth note of the mannual keyboard) starts to be played upon storage of the information corresponding to the thirteenth note (i.e. the information concerning the twelfth note of the manual keyboard.).

If the pedal tone is extremely attenuated when the truncate counter 106 is brought into operation, a carry signal CA is produced from the first channel of the counter. An arrangement has been made, however, to prevent the carry signal from entering the first channel of the overflow memory OVM, for this carry signal CA is irrelevant to the truncate operation for the manual tones. For this purpose, the signal $\overline{PCH}$ is applied to one of the inputs of the AND circuit $A_7$. Since the signal $\overline{PCH}$ is "0", the AND circuit $A_7$ does not pass the carry signal CA of the first channel and the first channel of the overflow memory OVM always remains in a "O" state. Accordingly, this output causes the truncate counter 106 to stop its truncate operation with respect to the manual tones only.

Nextly, an explanation will be given regarding the truncate operation for the pedal tones. When the signals AF, DS and PCH applied to the AND circuit $A_{19}$ are "1" respectively, decay of a pedal tone is detected. Again, when the output of the AND circuit $A_4$ and the signal PSC are "1", this indicates that a new key is being depressed in the pedal keyboard. When, accordingly, all of the inputs to the AND circuit $A_{19}$ are "1", a pedal tone clear signal is produced from the AND circuit $A_{19}$ and applied through the OR circuit $OR_9$ to the memory KAM and the other memories to clear these memories with respect to their first channel. Thus, a new note can be assigned to the first channel.

The output of the OR circuit $OR_{10}$ is fed to the first and second musical tone generators 1 and 2 as the counter clear signal CC for clearing contents of the first channel in the respective counters.

The second musical tone generator

Figure 10:
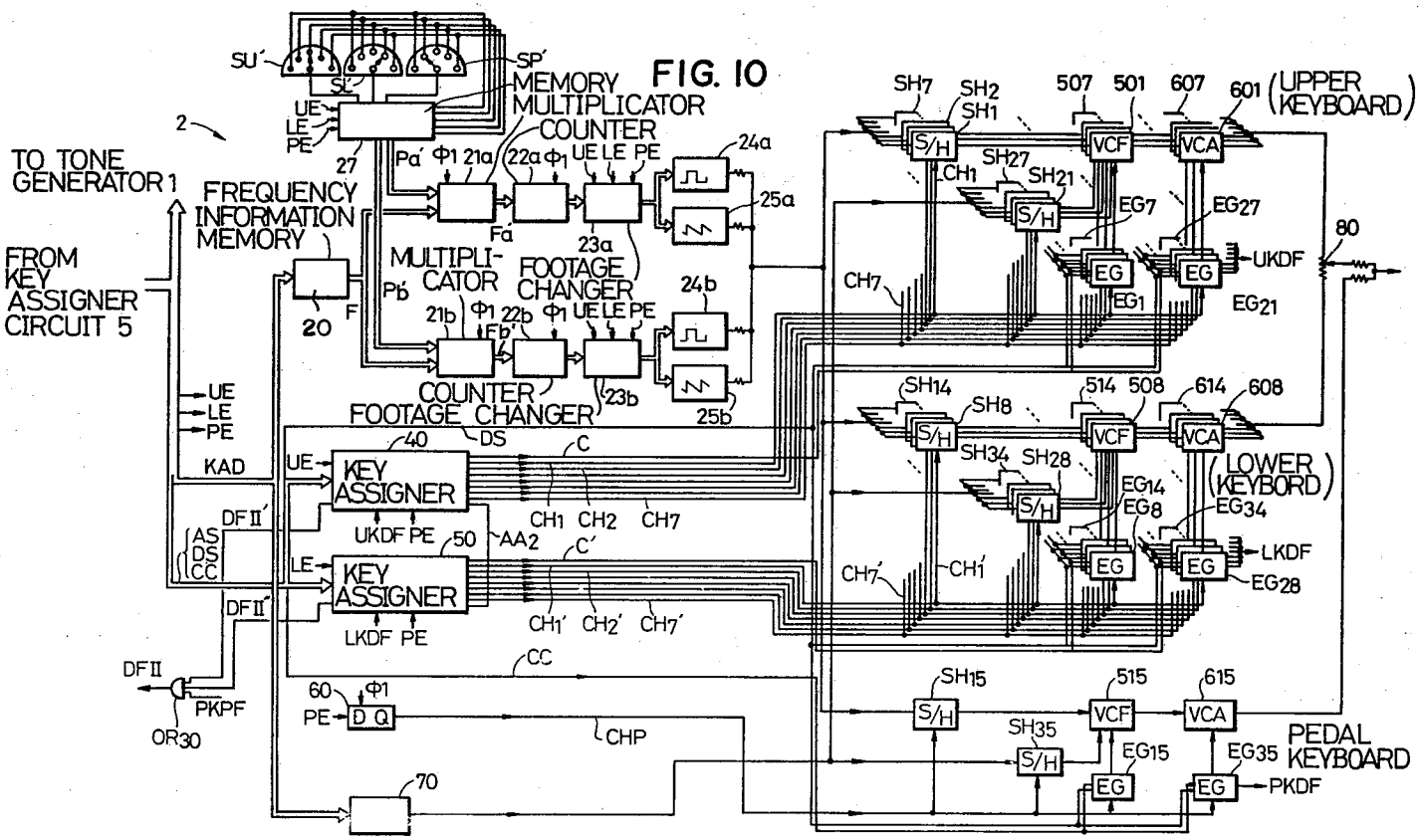

The second musical tone generator 2 shown in FIG. 10 is constructed to receive the key address signal KAD, the attack start signal AS, the decay start signal DS, the upper keyboard signal UE, the lower keyboard signal LE, the pedal keyboard signal PE and the counter clear signal CC from the key assigner circuit 5, the signals being multiplexed in time sharing for respective channels. Since the truncate operation is performed by the tone generator 1 it is not necessary to supply the truncate start signal to the tone generator 2. In the generator 2 too, the musical tone is generated and extinguished by using said signals KA through CC. There are provided plural series of tone color and volume control systems each constituting a static channel and including a voltage-controlled type filter and a voltage-controlled type amplifier, so as to produce plural tones for the respective channels. Tone color and volume control are also effected keyboard by keyboard and a static key assigner circuit is provided for dynamic-to-static assignment on the keyboard basis (i.e. reassigning). More specifically, while the tone color and volume control systems are provided in plural for parallel processing, assignment of the time division multiplexed data in each channel has been conducted in such a manner that data of a key has been assigned to any time slot (channel time) and, accordingly, in order to provide the tone color and volume controls to different keys of the same keyboard, it is necessary to reassign the tones of the respective time division channels to predetermined systems (static channel) provided for the particular keyboard. Otherwise there might arise such a problem that even when the upper keyboard is played, the musical tone is reproduced as a lower keyboard tone. Accordingly, the second tone generator 2 is constructed to perform (1) shaping of the tone source waveshape, (2) reassigning, and (3) the envelope control for controlling the tone color and volume.

(1) Shaping of the tone source waveform

Constructions of the frequency information memory 20, multiplicators 21*a* and 21*b*, waveshape counters 22*a* and 22*b*, pitch difference memory 17 and pitch difference selection switches SU', SL', and SP' shown in FIG. 10 are the same as those of the frequency information memory 10, multiplicators 11*a* and 11*b*, waveshape counters 12*a* and 12*b*, pitch difference memory 17 and pitch difference selection switches Su, SL and SP respectively, of the first musical tone generator 1 shown in FIG. 5. More particularly, frequency information F is read from the frequency information memory 20 in accordance with the key address signal KAD applied from the key assigner circuit 5, and the read out frequency signal is distributed to multiplicators 21*a* and 21*b* of the respective systems. The multiplicators operate to multiply the pitch difference designation values Pa' and Pb' read from the pitch memory 27 with the frequency information F for producing frequency information F*a*' and F*b*' representing mutually different pitches. The frequency information F*a* and F*b*' is successively integrated by waveshape counters 22*a* and 22*b* and the result of integration is used to read out the waveshape sampling point amplitude value from the waveshape memories 24*a* through 25*b*. The pitch difference designation values P'*a* and P'*b* corresponding to the cent values set by the selection switches SU' through Sp' of the respective keyboards are read from the pitch difference memory at a timing of the keyboard signals UE through PE in the same manner as has been described above. The set positions of the switches SU through SP and switches SU' through SP' do not always coincide with each other. Rather, the switches SU' through SP' are set at different positions from the switches SU through AP' where it is desired to form different beats by the first and second musical tone generators 1 and 2. The outputs from the waveshape counters 22*a* and 22*b* are used as address signals for reading out respective sampling point amplitude values of the tone source waveshapes stored in the respective waveshape memories 24*a* through 25*b*, and these address signals can be set in any desired tone ranges by footage changers 23*a* and 23*b*.

Assume now that one period of the tone source waveshape in the waveshape memories 24*a* through 25*b* comprises 64 sampling points. Then, each waveshape memory is required to have 64 addresses and each address signal from the waveshape counters 22*a* and 22*b* is required to have a capacity of 6 bits. Since the rate of accumulation by the counters 22*a* and 22*b* is constant, the sampling operation of the tone source waveshape is performed at a constant rate. Accordingly, by constantly multiplying the output data from the waveshape counters 22*a* and 22*b* by a factor 2, 4 . . . or $\frac{1}{2}$, $\frac{1}{4}$ . . . that is, by a factor of $2^n$ (where*n* represents any integer) and by accessing the waveshape memories 24*a* through 25*b* with the data multiplied by $2^n$, the tone source waveshape read from these memories will have a frequency of $2^n$ times the normal one thus changing the octave range (that is, footage) of the musical tone.

Figure 11:
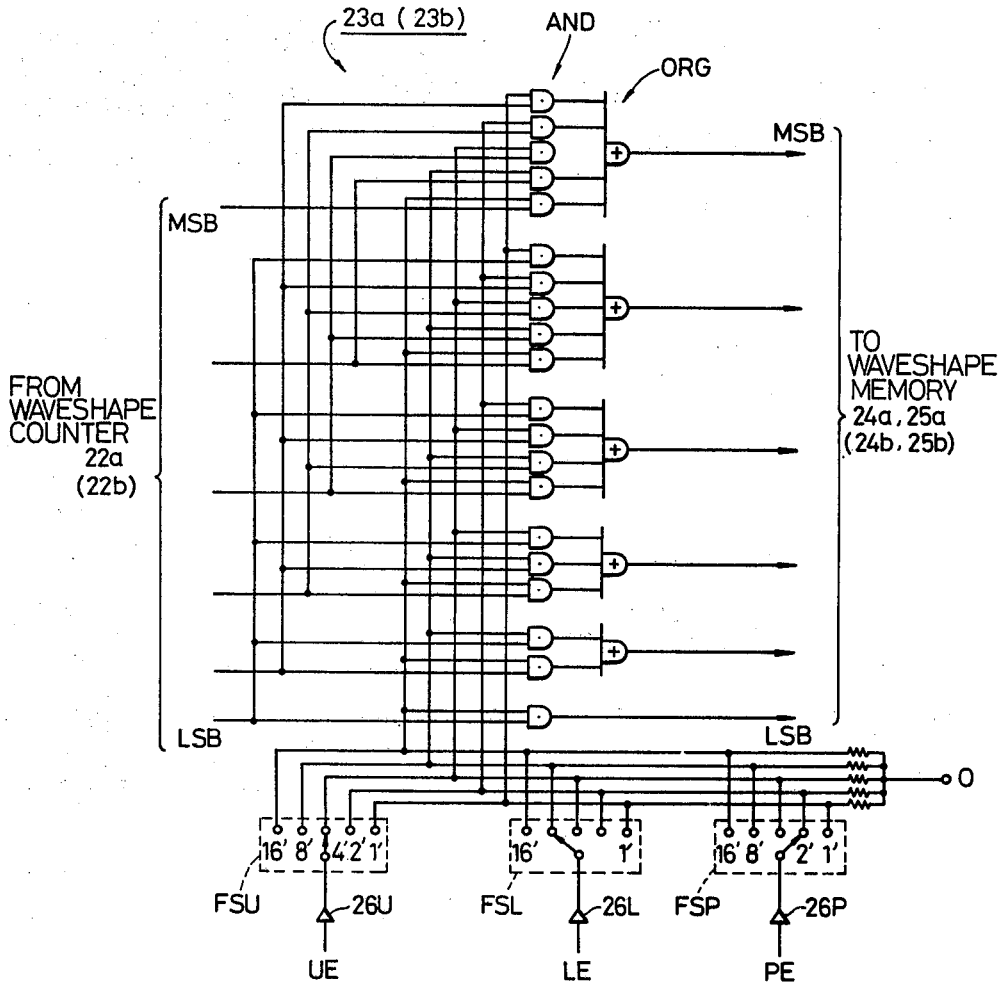

For the purpose of multiplying the output address signals from the waveshape counters 22*a* and 22*b* by a factor of $2^n$, there are provided footage changers 23*a* and 23*b* each comprising a shift circuit as shown in FIG. 11. Thus, shifting of the binary data by *n* bits to the side of the most significant digit MSB is equal to the multiplication by $2^n$ (where $n = 1, 2, 3 \ldots$) whereas shifting to the side of the least significant digit LSB by *n* bits is equal to the multiplication by $\frac{1}{2}n$. A plurality of AND circuits are combined as shown and the predetermined bits of the output data from waveshape counter 22*a* or 22*b* are applied to the respective AND circuits. The outputs of the respective AND circuts are combined by OR circuits ORG into groups, and the grouped outputs are applied to waveshape memories 24*a* and 25*a* (24*b* and 25*b*) respectively. The respective AND circuits also receive a signal that designates the amount of shift. The circuit is constructed such that the range of shift, i.e. the kinds of the footage registers, can be set for each of the respective keyboards, that is, to select one of the 1-foot, 2-foot, 4-foot, 8-foot and 16-foot tone registers when the footage designation switches FSU, FSL and FSP for the respective keyboards are operated. Since the kind of the keyboard to which the data presently being sent from the waveshape counters 22*a* and 22*b* belongs can be known by the keyboard signals UE, LE and PE, the upper keyboard signal UE, the lower keyboard signal LE and the pedal keyboard signal PE are applied to the common terminal of the corresponding switches FSU, FSL and FSP via buffer amplifiers 26u, 26L and 26P so that when a certain keyboard signal (UE, LE or PE) is generated, a signal "1" is sent to a line of the set footage register for that specific keyboard for enabling corresponding ones of the AND circuits and thereby performing the shifting.

The systems are provided with two sets of waveshape memories 24*a*, 24*b* and 25*a*, 25*b* respectively so as to store two different types of tone source waveshapes, e.g. a rectangular waveshape in the memories 24*a* and 24*b*, and a saw-tooth waveshape in the other memories 25*a* and 25*b*. Like the afore-mentioned waveshape memories $WM_1$ through $WM_{12}$ (see FIG. 5) the waveshape memories 24*a* through 25*b* are constructed to read out the sampling point amplitude values in terms of analog quantities in response to digital address inputs. The output from the footage changers 23*a* and 23*b* are applied respectively to waveshape memories 24*a*, 24*b* and 25*a*, 25*b* for simultaneously driving these two sets of memories. Alternatively, it is also possible to provide groups of AND circuits 28*a*, 28*b*, 28*c* and 28*d* (FIG. 12) on the input sides of the respective memories 24*a* through 25*b* for selectively driving the memories 24*a* through 25*b*.

The tone source waveshapes read from the waveshape memories 24a through 25b are subsequently subject to tone color control. For this reason, signals containing abundant harmonic content are stored in the memories 24a through 25b as the tone source waveshapes. Accordingly, this embodiment is constructed to select the tone source waveshape concurrently with selection of the tone colour. Thus, the groups of the AND circuits 28a through 28b are enabled in accordance with the tone source selection signal.

Figure 13:
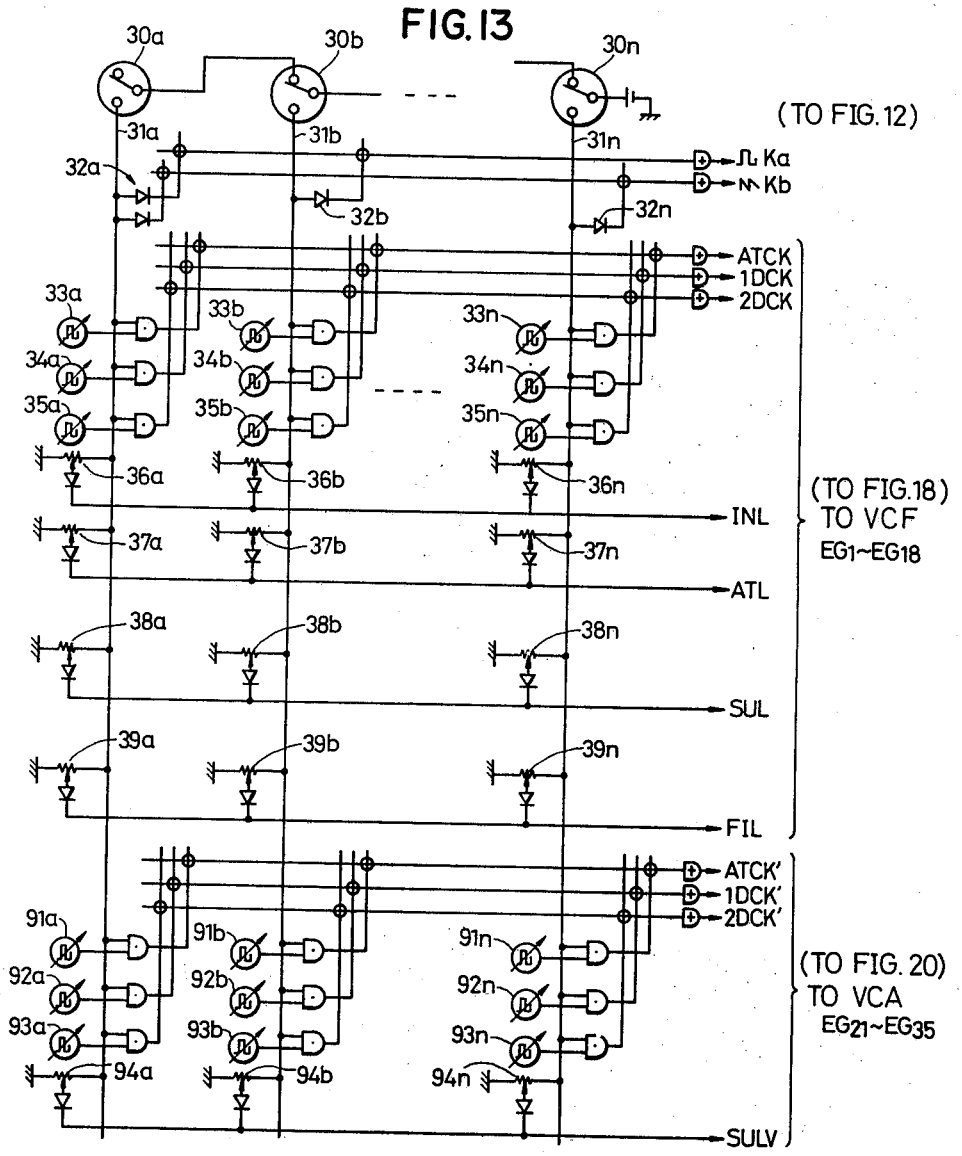

Although not shown in FIG. 10, the tone colour selection circuit comprises, as shown in FIG. 13, a plurality of tone colour selection switches 30a, 30b... 30n which are connected to preferentially select a particular one of the tone colours. More particularly, when one of the switches is closed, a positive voltage is applied to a common bus bar (one of 31a through 31n) corresponding to that switch for producing from the tone colour selection circuit signals representing variously set tone determining elements. Two tone source selection signals Ka and Kb are derived out through diodes 32a through 32n poled to apply the positive voltage upon a desired one of the two conductors. A rectangular wave is used for the tone source selection signal Ka whereas a saw tooth waveform for the tone source selection signal KB. FIG. 13 shows the tone color selection circuit for only one keyboard and it should be understood that similar circuits are provided for the respective keyboards thereby enabling selection of a tone colour with respect to each of the respective keyboards.

Figure 12:
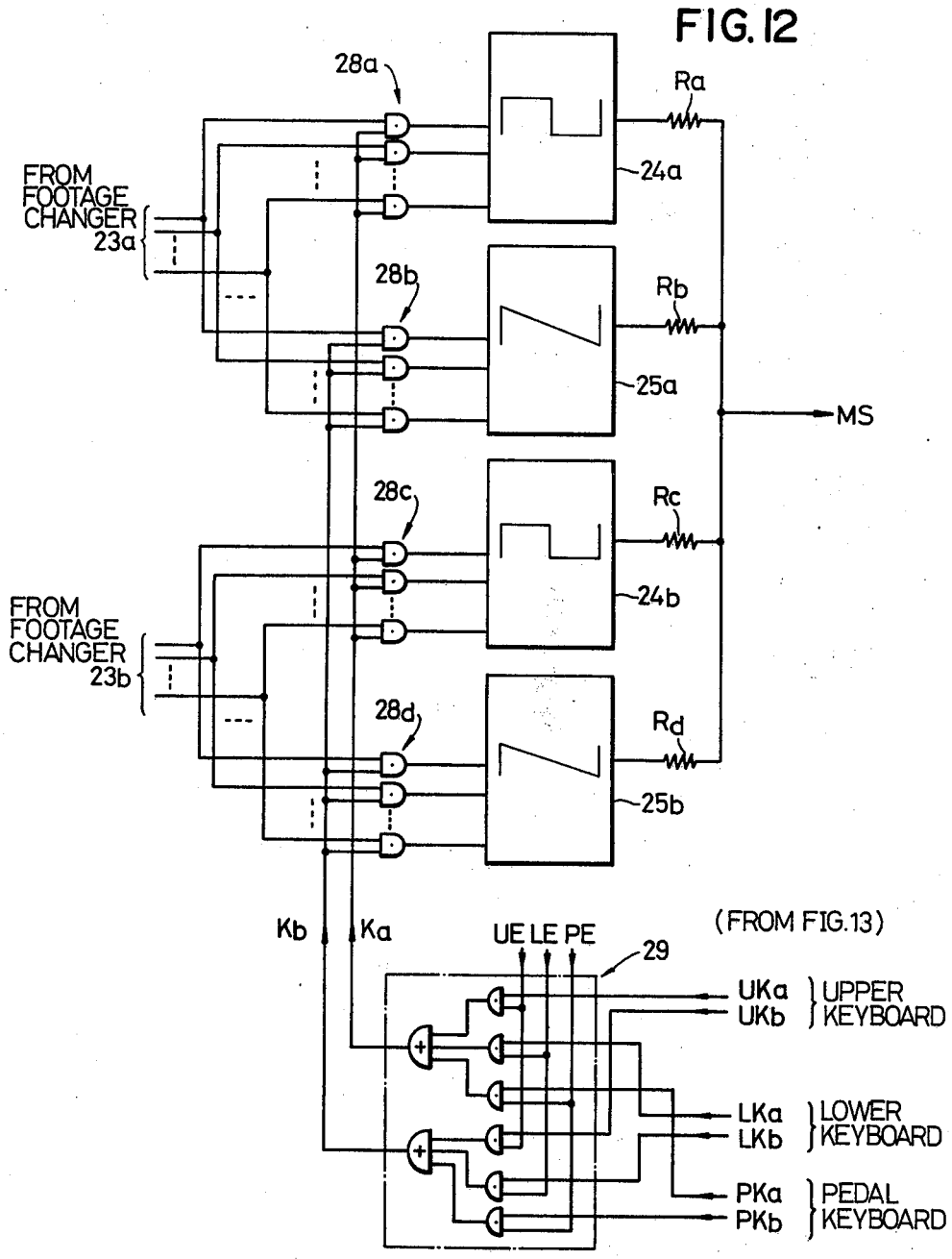

The tone source selection signals for the respective keyboards are applied to the respective data selection circuit 29 shown in FIG. 12 so as to drive the AND circuits in the data selection circuit 29 in accordance with the keyboard signals UE, LE and PE and thereby to select the tone source selection signals Ka and Kb of the keyboard to which the tone assigned to the particular channel time belongs. The output from the data selection circuit 29 is applied to corresponding groups of the AND circuits 28a through 28d. Assume, for example, that only a rectangular wave is selected for a particular keyboard as the tone source. When the footage changers 23a and 23b produce an address signal concerning a key belonging to the keyboard, signal Ka is changed to "1" in synchronism with the channel time of the address signal whereas signal Kb is "0". Accordingly, the waveshape memories 24a and 24b consecutively produce only rectangular waves.

The tone source waveshape signals read from the respective waveshape memories 24a through 25b are mixed together by resisters Ra through Rd and the resulting signal is applied to one output conductor. Where a maximum number of the tones are to be produced, all of the twelve tones are derived from the waveshape memories 24a through 25b as time shared multiplexed signals. Accordingly, in order to independently control the tone colour, volume etc. by subsequent circuits (for example, to vary them with time) it is necessary to assign tones of the respective channels to independent systems. Further, in order to independently control the tone and volume with respect to each of the keyboards, it is necessary to assign the tones to independent groups for the respective keyboards.

In this example, seven channels are assigned to the upper keyboard, seven channels to the lower keyboard and one channel to the pedal keyboard for the systems of controlling the tone color and volume. This means that the maximum number of tones of the upper keyboard is seven, that of the lower keyboard is seven and that of the pedal keyboard is one. However, since the circuit is constructed such that the tones of twelve channel assigned by the key assigner circuit 5 are reassigned, the total number of the tones to be produced does not exceed twelve.

In FIG. 10, seven sample-hold circuits $SH_1$ through $SH_7$ are connected in parallel for the upper keyboard system. Seven sample-hold circuits $SH_8$ through $SH_{14}$ are connected in parallel for the lower keyboard system and one sample-hold circuit $SH_{15}$ is provided for the pedal keyboard system. Time division multiplexed signals MS for twelve tones supplied from the waveshape memories 24a through 25b are applied in the sample-hold circuits $SH_{14}$ through $SH_{15}$, respectively, to be sampled and held by corresponding sample-hold circuits in synchronism with the channel times of the respective tones, which one of the keyboard systems samples and holds can be identified by the type of the keyboard signals UE, LE and PE which are generated in synchronism with said time division multiplexed tone source waveshape signals MS. However, a channel in the particular keyboard to whose sample-hold circuits $SH_1$ through $SH_7$ or sample-hold circuits $SH_8$ through $SH_{14}$ the signal should be assigned can not be determined by timing of the signal MS alone, because the key assigner circuit 5 assigns the tones irrespective of the kind of the keyboard. For this reason, the circuit of the second tone generator 2 is constructed to reassign the signals of the respective channels produced by the aforementioned key assigner circuit 5 to channels (7 channels in this case) for the respective keyboards. Although in the key assigner circuit 5 tones are assigned to channels that can be discriminated on the basic of time, in the second tone generator 2 these assigned tones are reassigned to channels (control systems for tone color and volume of the respective keyboards) which are connected in parallel and can be identified in the form of fixed channels. For the purpose of discriminating the channels used in the second tone generator 2 from the channels to which signals are assigned by the key assigner circuit 5, the former is herein defined as "fixed channels".

2. Reassigning operation

Since only one channel which is the first channel is assigned for the pedal keyboard, the reassignment is not necessary. It is possible to assign the tone source signal MS of the pedal keyboard to the tone color and volume control system exclusively provided for the pedal keyboard by sampling the signal by the sample-hold circuit $SH_{15}$ in synchronism with the timing with which the pedal keyboard signal PE is sent out.

For the purpose of reassigning the channels of the upper and lower keyboards, there are provided a key assigner 40 for the upper keyboard and a key assigner 50 for the lower keyboard (See FIG. 10) both of a static types. The key assigner 40 for the upper keyboard selects only one of the attack start signals AS (When the signal AS is generated in a given channel time, it signifies that the depressed key is assigned to that channel.) which is in synchronism with the upper keyboard signal UE (such selection representing that the selected attack signal is related to a key of the upper keyboard), and reassigns the signal AS of the selected channel time to one static channel among the seven parallel channels for the upper keyboard without losing the channel identity. (In other words, the signal of one channel time regarding the upper keyboard is assigned to one of seven output conductors corresponding to the respective static channels. The key assigner 50 for the lower keyboard reassigns signal AS of the channel time synchronous with the lower keyboard signal LE to the static channel for the lower keyboard. Since the key assigners 40 and 50 have the same construction and operate similarly, only the key assigner 40 for the upper keyboard will be described in detail with reference to FIG. 14.

Figure 14:
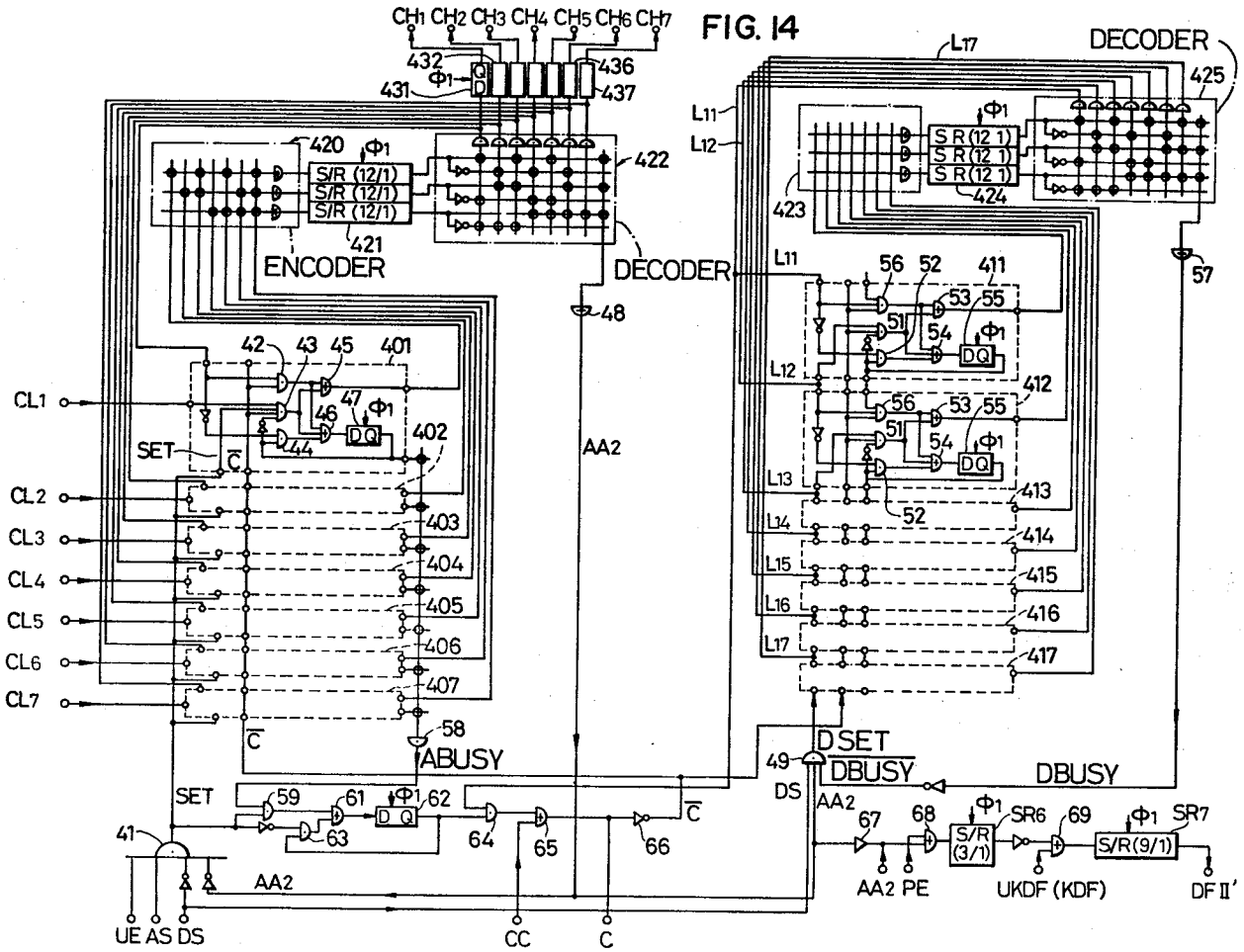
Figure 15:
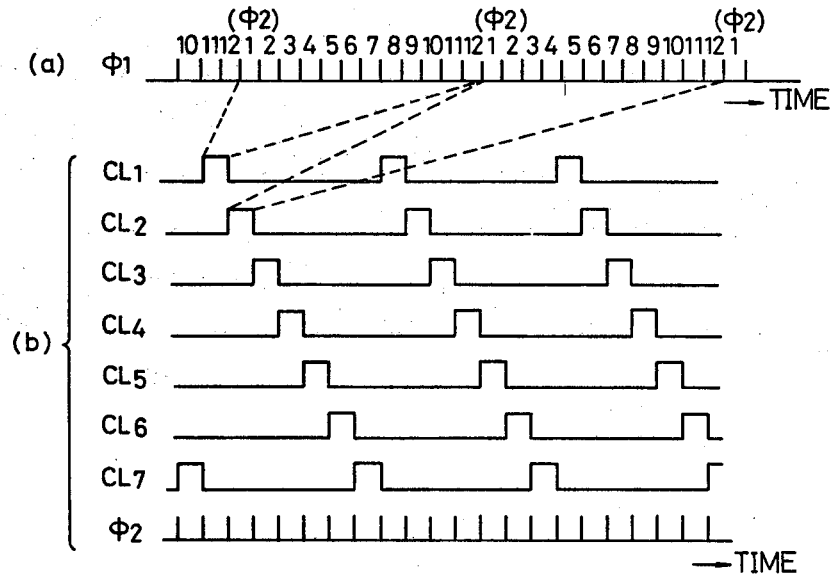

As shown in FIG. 14, the key assigner 40 comprises reassigning registration units 401 through 407 respectively corresponding to first to seventh static channels. Although the reassigning registration circuit 401 only of the first static channel is shown in detail, it should be understood that other registration circuits 402 through 407 have the same circuit construction. When tone generation is assigned to a given static channel, a binary signal "1" is stored in the delay flip-flop circuits 47 of the registration circuits 401 through 407 corresponding to said channel. This stored signal represents that reassignment has been registered for the given static channel. Such registration is done with the timing of the clock pulse for controlling the reassigning operation. As shown in FIG. 15 (b), each one of the clock pulses $CL_1$ through $CL_7$ has a pulse width corresponding to 12 main clock pulses $\phi_1$ (see FIG. 15 (a)) namely the width of one key time, and the clock pulses $CL_1$ through $CL_7$ are generated sequentially in synchronism with respective build up times of the key clock pulse. Thus, each one of the clock pulses $CL_1$ through $CL_7$ persists during an interval of the first channel time to the twelfth channel time and when one clock pulse ($CL_1$) builds down at the end of the twelfth channel time, the next clock pulse ($CL_2$) builds up at the beginning of the next first channel time. In this manner, the clock pulses are generated sequentially. Accordingly the period of each one of the clock pulses $CL_1$ through $CL_7$ is equal to 7 key times.

The conditions of reassignment are as follows:

(A') That a key is depressed and a tone regarding that key is assigned to a particular channel time by the key assigner circuit 5 . . . that is, the attack start signal AS is "1".

(B') That said key is not released . . . that is, the decay start signal DS is "0".

(C') That said key belongs to the upper keyboard (in the case of the key assigner 50, the lower keyboard) . . . that is, the upper keyboard signal UE is "1" (in the case of the key assigner 50, the lower keyboard signal LE).

(D') That said key is not yet reassigned by the key assigner 40 (not registered in any one of the registration circuits 401 through 407) . . . that is, signal $AA_2$ is "0".

(E') That there is an empty channel among the seven static channels for the upper keyboard that is not yet assigned with tones to be generated, that is, at least one of the registration circuits 401 through 407 is available for registration.

Four conditions A' through D' can be detected by AND circuit 41 having its inputs connected to receive signal AS, DS, UE and $AA_2$. When conditions A' through D' are all satisfied, AND circuit 41 produces an output "1" which is applied in parallel to all the assignment registration circuits 401 through 407 as a set signal SET. Since clock pulse $CL_1$ through $CL_7$ for controlling the reassigning operation are applied to the assignment registration circuits 401 through 407 respectively these circuits are enabled sequentially by the clock pulses.

Figure 16:
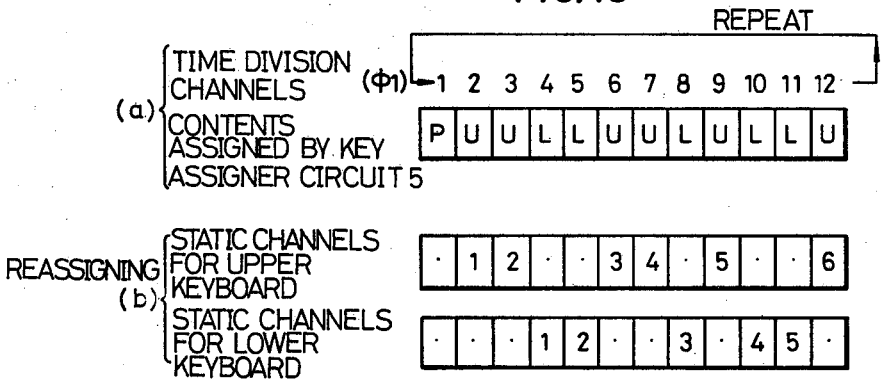

Assume now that when the contents of the time division chennels 1 through 12 which are assigned with signals by the key assigner circuit 5 are as shown in FIG. 16 when expressed only in terms of the kind of the keyboard, wherein U shows the upper keyboard, L the lower keyboard and P the pedal keyboard. More particularly, keyboard signals UE, LE and PE are sent out from the key assigner circuit in time-sharing as shown in FIG. 16(a). Other signals KAD to CC are sent out in synchronism with these keyboard signals. For the sake of description, it is now assumed that none of the registration circuits 401 through 407 has registered the reassignment of the signal yet. Let us consider one key time in which the clock pulse $CL_1$ is at "1" state under these conditions. At this time, since other clock pulses $CL_2$ through $CL_7$ are at "0" state, only the registration circuit 401 relating to the first fixed channel is in the operable (available for registration) condition. It is also assumed that an inverted signal $\overline{C}$ of clear signal C is "1" at this time.

When the conditions A' through D' are satisfied at the time of the second channel time, AND circuit 41 produces an output "1" which is applied to one input of the AND circuit 43 of the registration circuit 401 to act as the set signal SET. The other input to the AND circuit 43 is a "1" signal obtained by inverting the output from the flip-flop circuit 47 by an inverter. Since the inverted clear signal $\overline{C}$ and the clock signal $CL_1$ are also "1" signals, the AND circuit 43 produces an output signal "1" which is applied to a flip-flop circuit 47 via an OR circuit 46 to enable the same. As the same time, a signal "1" is applied to an encoder 420 through an OR circuit 45. In response to the input from the registration circuit 401 through the OR circuit 45, the encoder 420 produces a 3-bit code signal representing the first static channel, which is applied to a 12-stage/3-bit shift register 421.

Figure 17:
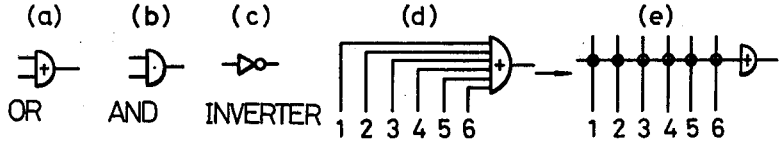

The encoder 420 is constituted by a combination of the input lines of three OR circuits each depicted in a simplified fashion. Generally the OR circuit is represented by a symbol as shown in FIG. 17(a), while the AND circuit and the inverter are represented by symbols as shown in FIGS. 17(b) and 17(c) respectively. Where an OR circuit or an AND circuit has a more plurality of inputs as shown in FIG. 17(d), the connections of the inputs are simplified as shown in FIG. 17(e) for the purpose of simplifying the drawing. For example, where an OR circuit has six inputs 1 through 6, these inputs are connected to a single line or the input side of the OR circuit as shown in FIG. 17(e). The cross-points between the single line and 6 input lines being rounded by small circles.

The connection of the inputs to the OR circuit of the encoder 420 shown in FIG. 14 can readily be understood from FIG. 17(e).

The shift register 421 is constructed to be shifted sequentially by the main clock pulse $\phi_1$ so as to delay the code signal received from the encoder 420 by one key time (corresponding to 12 bits of the main clock pulse $\phi_1$) thus producing the delayed code signal as its output. As a result, the channel times of the input and output signals of the shift register 421 coincide with each other. By decoder 422, the output from the register 421 is decoded according to the contents of the code into one of 7 outputs corresponding to the respective static channels. The decoder 422 is constituted by AND circuits and inverters. The 7 output conductors of the decoder 422 are connected to the respective registration circuits 401 through 407 corresponding to the respective static channels, and also to flip-flop circuits 431 through 437 delayed by the main clock pulse $\phi_1$, from which static channel signals $CH_1$ through $CH_7$ are parallelly produced.

The set signal applied to the flip-flop circuit 47 of the registration circuit 401 is delayed by main clock pulse $\phi_1$ and then produced by the flip-flop circuit at the time of the third channel time. This output signal "1" is applied to AND circuit 42 and also to AND circuit 43 through an inverter to disenable the AND circuit 43. To the other input of the AND circuit 44 is applide the output from the first static channel of the decoder 422 via an inverter. However, since one key time has not yet elapsed after the flip-flop circuit 47 has been set, a signal "1" will be applied to AND circuit 44. As a result, the AND circuit 44 produces "1" output which sets the flip-flop circuit 47 again via OR circuit 46. In this manner, this flip-flop circuit self-holds to store signal "1".

When the second channel time is reached after the elapse of one key time, the register produces a delayed code signal in the above described manner. As the OR circuit 48 receives three output bits from the shift register 421 it detects the condition D' described above. If the signal of that channel time has already been reassigned, same code signal (not including 000) would be produced by the register 421 thereby causing OR circuit 48 to produce a signal "1". In other words, the fact that the output signal $AA_2$ from the OR circuit 48 is "O" means that the condition D' is satisfied. When the register 421 produces the code signal of the first static channel, the output $AA_2$ from OR circuit 48 becomes "1" state to disenable the AND circuit 41 with the result that no set signal SET is produced. However, a signal "1" from the decoder 422 is applied to one input of the AND circuit 42 of the registration circuit 401. Thus, AND circuit 44 is disenabled and the self-hold loop for the flip-flop circuit is interrupted temporarily but the condition of the AND circuit 42 holds (signal $\overline{C} = 1$) so that the output signal 1 from the AND circuit 42 is applied to the flip-flop circuit 47 via the OR circuit 46 thereby setting the flip-flop circuit.

In this manner, the memory of the flip-flop circuit 47 is preserved continuously. This condition of storing signal "1" in the flip-flop circuit 47 represents the reassignment of the signal (tone) of a given channel time to a corresponding static channel.

However, signals $CH_1$ through $CH_7$ of the respective static channels reassigned in this manner are not produced continuously but instead produced intermittently in synchronism with the original channel times and corresponds in time to the assigning operation of the key assigner circuit 5. In other words, the signal "1" supplied to the AND circuit 42 from the decoder 422 in the second channel time is reapplied to the encoder 420 via OR circuits 45, and after one key time this signal appears on the output side of the shift register 421 in the second channel time. Accordingly, in this case, signal $CH_2$ of the first static channel is produced only in a time slot of the second channel time. Thus, as shown in FIG. 16*b*, the signal (tone) of the second channel time assigned by the second key assigner circuit 5 is reassigned to the static channel No. 1 for the upper keyboard and this first static channel signal $CH_1$ is produced in the time slot of the second channel time alone. The delay flip-flop circuit 431 through 437 on the output stage are provided for the purpose of synchronizing them with other circuits (for example, musical tone waveshape forming systems) and do not constitute an essential element of this invention.

Assume now that the keys of the upper keyboard U have been assigned to the third channel time by the key assigner circuit 5 as shown in FIG. 16(a), that the condition of AND circuit 41 has been satisfied, that the set signal SET has been produced in the third channel time, and that the clock pulse $CL_1$ for controlling the reassigning operation is "1". Then the AND circuit 43 of the registration circuit 401 would be disenabled because the flip-flop circuit 47 of the registration circuit 401 is storing signal "1". Accordingly, condition E' is not satisfied. When the next key time is reached, clock pulse $CL_2$ becomes "1", thus turning the registration circuit 402 to the operable condition. In this key time too, the set signal SET is similarly generated in the third channel time. Since the output signal from the flip-flop circuit 47 of the registration circuit 402 is "O", it indicates that condition E' is satisfied. Accordingly, all conditions A' through E' are satisfied and the signal (tone) in the third channel time is reassigned to the second static channel in the same manner as has been described above. Thus, the second channel signal $CH_2$ is generated in synchronism with the third channel time.

In the same manner, the signals from the key assigner circuit 5 which are multiplexed in time sharing according to the assigning schedule as shown in FIG. 16(a) are reassigned to the respective static channels as shown in FIG. 16(b). In the key assigner 50 for the lower keyboard, signals are similarly reassigned to the respective static channels for the lower keyboard. It will be clear that it is not necessary to always assign the signals according to the order shown in FIG. 16(b) and that the signals may be assigned according to their order of appearance.

As shown in FIG. 10, the pedal keyboard signal PE is delayed on clock pulse by the delay flip-flop 60 and is utilized as a pedal channel signal CHP. Similarly to the abovementioned delay flip-flop circuits 431 through 437 shown in FIG. 14, the delay flip-flop circuit 60 is provided for the purpose of synchronizing with other circuits.

Operation in the event that the keys of the tones of channel times which have been registered in the respective registration circuits 401 through 407 have been released will now be described.

In the key assigner 40 shown in FIG. 14, the AND circuit 49 supplied with decay start signal DS, output signal $AA_2$ from OR gate circut 48 and $\overline{DBUSY}$ signal produces an output signal "1" only when the following conditions A'', B'' and C'' are satisfied, said output signal being used as a decay set signal DSET.

(A'') that a key assigned to a given channel time by the key assigner circuit 5 is released, i.e. the tone of that channel time is attenuating, the decay star signal DS being "1".

(B'') that the key has already been reassigned by the key assigner 40, that is, registered in one of the registration circuits 401 through 407, registered signal $AA_2$ being "1"; and (C'') that the release of the key is not yet stored in the key assignor 40, signal DBUSY being "0" whereas signal $\overline{DBUSY}$ being "1".

Generation of the decay set signal DSET means that one of the tones that have been reassigned to the static channels for the upper keyboard by the operation of the key assigner has been released and under attenuation. In other words, this means that a key is released of the static channel to which a tone has been reassigned of the channel time identical with the channel time in which the decay set signal DSET has generated.

A plurality of key release memory circuits of the same number as the static channels (7 in this example) are provided for storing the decay set signal DSET. These key release memory circuits 411 through 417 are serially numbered so as to store in the key release memory circuit the signal of the channel time in which the release was made at the ealiast time (that is, attenuation has proceeded to the furthest degree of the seven static channels). The key release is successively stored in the memory circuit 412, 413 . . . 417 according to the order of release.

The decay set signal DSET from the AND circuit 49 is applied to the key release memory circuit 417 adapted to store the newest key release. The key release memory circuit 401 through 417 have substantially the same construction so that only circuits 411 and 412 are shown in detail but each of the other memory circuits 413 through 417 comprises AND circuits 51, 52 and 56, OR circuits 53 and 54 and a delay flop-flop circuit 55. Although, for the sake of description, the same reference numerals 51 through 56 have been assigned to the respective key release memory circuits 411 through 417, it should be understood that they are discrete units having the same operation. The output of the OR circuits of each one of the memory circuits 411 through 417 is applied to the encoder 423 to form a 3-bit code signal representing a particular memory circuit. The output from the encoder 423 is applied to a 12 stage/3-bit shift register 424 delayed by one key time corresponding to 12 main clock pulses $\phi_1$. The output from the shift register 424 is applied to decoder 425 which decodes the code signals of the respective memory circuits 411 through 417 into signals on output conductor $L_{11}$ through $L_{17}$ corresponding to the respective key release memory circuits 411 through 417. The output from the shoft register 424 is also applied to OR circuit 57 through a decoder 425 to produce DBUSY signal. In the absence of a code signal (that is, at the time of code 000) DBUSY signal is "0" showing that key release has not yet been stored (that is $\overline{DBUSY} = 1$). The outputs on output conductors $L_{11}$ through $L_{17}$ of the decoder 425 are connected to AND circuit 56 of corresponding circuits 411–417 and also to one input of AND circuit 52 after being inverted by respective inverters. The signals on output conductors $L_{12}$ through $L_{17}$ are applied to one inputs of the AND circuit 51 of the circuits 411 through 416 one order higher than circuits 412 through 417 corresponding to conductors $L_{12}$ through $L_{17}$. The output conductor $L_{11}$ corresponding to the most significant circuit 411 which stores the earliest key release is not associated with a key release memory circuit of the higher order so that the "1" signal applied to conductor $L_{11}$ is used in a manner to be described later as signal OLD that represents a channel in which the attenuation of the signal has advanced to the further degree. The AND circuit 51 of the least significant circuit 417 that stores the latest key release is not connected with any one of the output conductor $L_{11}$ through $L_{17}$ from decoder 425. Instead, the decay set signal DSET from said AND circuit 49 is applied to the AND circuit 51 of the key release memory circuit 417. Other two inputs of the AND gate circuit 51 of the key release memory circuits 411 through 417 are connected to receive an inverted clear signal $\overline{C}$ and the inverted outputs of flip-flop circuits 55 of the memory circuits 411 through 417. The output of the delay flop-flop circuit is applied to the AND circuit 52 of each one of the key release memory circuits 411 through 417 and to one input of the AND circuit 56 of the key release memory circuits 412 through 417 respectively which are lower by one order. Normally, signal "1" is applied to one input of the AND circuit 56 of the most significant circuit 411.

It is assumed that a key corresponding to a tone that has been assigned to the second channel time by the assigning circuit 5 is now released. Then, AND circuit 49 provides a decay set signal DSET in a time slot of the second channel time. This decay set signal DSET is applied to the input of the AND circuit 51 of the least significant key release memory circuit 417. At this time, since signals applied to other two inputs of the AND circuit 51 are "1" (under an assumption that the inverted clear signal $\overline{C}$ is "1" and that the flip-flop circuit 55 is in its reset state), AND circuit 51 is enabled to produce an output signal "1" which is applied to flip-flop circuit 55 through OR circuit 54 to set the flip-flop circuit, and to encoder 423 via OR circuit 53 thereby applying the code signal from the key release memory circuit 417 to the shift register 424. When a signal "1" which is delayed by one channel time by the main clock pulse $\phi_1$ is delivered from the flip-flop circuit 55, since the signal on the output conductor $L_{17}$ of the decoder 425 is "0" because it was produced 12 microseconds before (which corresponds to 12 main clock pulses $\phi_1$), this signal is inverted into a "1" signal by the inverter and applied to the AND circuit 52. As a result, the condition of the AND circuit 52 is held to set again the flip-flop circuit 55 thereby causing it to hold its memory.

As the second channel time is reached after the lapse of an interval corresponding to 12 main clock pulses $\phi_1$, the code signal of the key release memory circuit 417 is produced by the shift register 424 whereby signal "1" is produced on the output conductor $L_{17}$ of the decoder 425 which acts to apply to the AND circuit 52 of the key release memory circuit 417 a signal "0" inverted by the inverter thereby releasing the self-holding action of the flip-flop circuit 55 of the key release memory circuit 417. Although the output from the flip-flop circuit 55 of the key release memory circuit 416 at a higher order is applied to one input of the AND circuit 56 of the least significant memory circuit 417, where the flip-flop circuit 55 of the memory circuit 416 has not been set (that is the memory circuit 416 does not yet store the key release) the AND circuit 56 of the memory circuit 417 is disenabled by signal "0" so that the flip-flop circuit 55 of the key release circuit 417 will not receive any set input. However, since the signal "1" on the output conductor $L_{17}$ is also applied to the AND circuit of the key release memory circuit 416 at a higher order, the memory circuit 416 will assume a state as if it received a decay reset signal DSET. In this manner, the decay signals DSET are sequentially transferred to the key release memory circuits 411 through 416 at the higher order by the signal "1" on the output conductors $L_{12}$ through $L_{17}$ corresponding to the key release memory circuits 412 through 417 one order below.

As in the key release memory circuit 417, also in the key release memory circuit 416, the flip-flop circuit 55 is set for self-holding for an interval equal to 12 main clock pulses. When the second channel time is reached, a signal "1" is produced on the output conductor $L_{16}$ so as to judge whether the decay set signal DSET should the shifted or not to the circuit at a higher order by detecting the memory contents of the flip-flop circuit 55 of the key release circuit at a higher order. In this manner, so long as the key release memory circuit 416 through 411 at higher orders have not yet stored the signal, the key release signals 1 are sequentially produced on output conductors $L_{17}$ through $L_{12}$ thus setting the flip-flop circuit 55 of the most significant key release memory circuit 411. When signal "1" is produced on the output conductor $L_{11}$, the self-holding state of the flip-flot circuit 55 of the key release circuit 411 is released temporarily but the AND circuit 56 is enabled to set again the flip-flop circuit 55. In this manner, the memory in the flip-flop circuit of the key release circuit 411 is preserved with the result that signal "1" is produced on the output conductor $L_{11}$ at each second channel time.

Let us now consider a case wherein a key assigned to a certain channel time, e.g. the third channel time is released. At the time of the third channel time, a decay set signal DSET is produced which is sequentially shifted to the memory circuit of upper orders and finally stored in the key release memory circuit 412. Since in the most significant key release memory circuit 411 signal "1" has already been stored in its flip-flop circuit 55, the AND circuit 51 of the key release memory circuit 411 will be maintained in the disenabled state even when a signal is produced on the output conductor $L_{12}$ at the third channel time. However, the signal "1" from the flip-flop circuit 55 of the most significant key release memory circuit 411 is applied to one input of the AND circuit 56 of the key release memory circuit 412, the flip-flop circuit 55 thereof is set again to preserve its memory. In this manner, signals are sequentially stored in the respective key release memory circuits 411 through 417 starting from the earliest signal (that is, attenuated to the further degree). Consequently, the old signal OLD appearing on the output conductor $L_{11}$ represents a channel in which the attenuation is the greatest, and the type of the channels can be discriminated according to the channel time in which signal "1" is produced on the output conductor $L_{11}$. To which one of the static channels the tone of a given channel has been reassigned by the key assignor 40 can be determined by the timing of generation of the respective static channel signals $CH_1$ through $CH_7$ (the outputs from the decoder 422). That is the tones whose channel times coincide with each other are reassigned. In the example described hereinabove, as can be noted from FIG. 16, the tone of the second channel time in which the signal OLD has been generated is reassigned to the first static channel of the registration circuit 401.

Where the memory of an upper key release memory circuit, for example memory circuit 411, is released by the fact that the output $\overline{C}$ of the inversion clear circuit becomes "0", the memory channel of the key release memory circuit one order lower (for example 412) is shifted to a higher order memory circuit 411.

The truncate control operation of the key assigner 40 (or 50) is as follows: In this example, the maximum number of the tones generated by each of the upper and lower keyboards is 7 and the total number of the tones to be reproduced is twelve. As a result, there arises a case wherein more than seven tones are assigned for one keyboard by the key assigner circuit 5. Tones of the 8th or higher orders are not reassigned by the key assigner 40 so that they are not produced by the second musical tone generator 2. However, where there is a tone on which the key has already been released (undergoing attenuation), a truncate control operation similar to that of the key assigner circuit 5 is performed.

The conditions under which the truncate control operation in the key assigner 40 is conducted are: (1) That tones are assigned to all of the static channels so that all the static channels are operating to produce tones . . . . that is, all busy signals ABUSY are "1". (2) That there is a tone undergoing attenuation, that is, an old signal OLD is being generated; and (3) That the 8th tone of the upper (or lower) keyboard has been assigned by the key assigner circuit 5 . . . that is the set signal from AND circuit 41 is "1".

When all of these conditions are satisfied, the truncate control operation is performed.

The all busy signal ABUSY is generated by AND gate circuit 58 which receives the outputs of the flip-flop circuits 47 of the respective registration circuits 401 through 407. As long as all the flip-flop circuits 47 preserve signals "1", the condition (1) will be satisfied and the output from the AND gate circuit 58 is "1". All busy signal ABUSY is applied from AND circuits 58 to AND circuit and 59. Under these conditions, when a set signal SET is generated in the channel time of the 8th tone, delay flip-flop circuit 62 is set by this set signal through AND circuit 59 and OR circuit 61. When delayed one channel time by the main clock pulse $\phi_1$, the set signal SET disappears, but the flip-flop circuit 62 is caused to self-hold its memory through the AND circuit 63.

The output from the flip-flop circuit 62 is applied to one input of a AND circuit 64 while the other input thereof is connected to the conductor $L_{11}$ to receive the old signal OLD. Thus, when an old signal OLD is generated at the channel time of a tone which has undergone the largest attenuation, aforementioned conditions 1 to 3 are satisfied and the AND circuit 64 will produce a signal "1" which is converted into a clear signal C through OR circuit 65 and then converted into the inverted clear signal $\overline{C}$ by an inverter 66. Since the inverted clear signal $\overline{C}$ is "0", the memories in the respective registration circuit 401 through 407 and in the key release memory circuits 411 through 417 are inhibited at a timing with which the old signal OLD is produced (in the second channel time, for example). That is, AND circuits 42, 43, 51 and 56 are disenabled.

Where the signals are assigned as shown in FIG. 16, for example, a signal corresponding to the registration circuit will be produced by the decoder 422 at the second channel time, but since the signal $\overline{C}$ applied to the AND circuit 42 of the registration circuit 401 is "0", the memory in the flip-flop circuit 47 is released. Accordingly, the first static channel becomes empty. Further, the AND circuit 56 of the key release memory circuit 411 is also disenabled to release the memory regarding the key release at the second channel time. Then, while the clock pulse $CL_1$ is being generated, when a set signal SET is produced at the channel time of the 8th tone, that tone will be assigned to the first static channel of the registration circuit 401. Further, a counter clear signal CC to the OR circuit 65 is applied from the key assigner circuit 5 and this signal CC produces a clear signal C ($\overline{C} = 0$).

In the first musical tone generator 1, when tone generation of a certain channel is completed, a decay finish signal DFI is produced at that channel time (FIG. 9) and the decay finish signal DFI is applied to one input of AND circuit $A_{20}$ of the assigner circuit (FIG. 4). The other input of the AND circuit $A_{20}$ is connected to receive the decay finish signal DFII from the second musical tone generator 2. This is because various clear signals are generated in both generators 1 and 2 when tone generation of given channels is completed. Since the envelope control is not the same in the generators 1 and 2, the time completing tone generation does not coincide with each other. Accordingly, there arises a problem that when a clear signal is generated upon completion of generation of the tone in one generator, generation of the tone from the other generator will be terminated on the half-way. For the purpose of preventing this disadvantage, the circuit is constructed such that only when both signals DFI and DFII are applied to the inputs of AND gate circuit $A_{20}$, various clear signals (such as signal CC) are generated for clearing the memory of the entire apparatus regarding a particular channel.

The decay finish signal DFII of the seconed tone generator 2 is produced by a 9-stage/1-bit but shift register $SR_7$ shown in FIG. 14 for each keyboard. Respective envelope generators $EG_1$ through $EG_7$ and $EG_8$ through $EG_{15}$ generater decay finish signals KDG representing the termination of the tones of the respective static channels and these decay finish signals for each keyboard are mixed together in single conductors to form signals UKDF, LKDF and PKDF of which the former two signals are applied to the inputs of OR circuits 69 of the respective key assigners 40 and 50. Depending upon the design of the envelope generators, signals KDF(UKDF-PKDF) are generated 3 channel times later than signals $AA_2$ and $AA'_2$ of the key assigner 40 or 50. For this reason, these signals are synchronized by a 3-stage 1-bit shift register $SR_6$ and then delayed by 9 channels times by shift register $SR_7$ for coinciding the respective channel times of the time slots of the key assigner circuit 5. Thus, shift registers $SR_6$ and $SR_7$ are provided to most design requirements of this embodiment and do not constitute the essential feature of this invention. Signal $AA_2'$ is signal representing that the registration has been completed for the key assigner 50 for the lower keyboard (same as signal $AA_2$ of the key assignor 40) and signal PE is a pedal keyboard signal. Signals $AA_2$ and $AA_2'$ are combined on the output side of a buffer amplifier 67 and the combined signal is applied to the inputs of OR circuit 68 together with signal PE. These signals pass through shift register $SR_6$, are inverted by an inverter, and then combined with signal UKDF to form the decay finish signal DFII' for the upper keyboard. Signal DFII' functions as a quasi-decay finish signal. This is because, as described above, all tones assigned by the key assigner circuit 5 and not always generated by the second musical tone generator 2, and because the decay finish signals KDF of the 8th tone and the tones of the higher orders that were not reassigned by the key assignor 40 and 50 are not produced. Of course, the first musical tone generator 1 generates signal DFI regarding its tone so that in order to establish a condition for enabling AND circuit $A_{20}$ (FIG. 4) it is necessary to generate a quasi-decay finish signal. Accordingly, the circuit is so constructed that signals $AA_2$ and $AA'_2$ are "0" (not reassigned) and that during the pedal channel time (that is signal DE="0") an inverter applies a signal "1" (quasi-decay finish signal) to OR circuit 69. The decay finish signals DFII' and DFII" from the respective key assigners 40 and 50 and pedal key decay finish signal PKDF are applied to the inputs of an OR circuit $OR_{30}$ (FIG. 10) to form a signal DFII which is applied to the assigning circuit 5.

In this manner, the key assigners 40 and 50 produce static channel signals $CH_1 - CH_7$ and $CH_1' - CH_7'$. Since 1-bit delay flip-flop circuits 431 through 437 (FIG. 14) are provided on the output stage of the key assigner 40 (50) the pedal keyboard signal PE is delayed by a 1-bit delay flip-flop circuit 60 to produce a pedal fixed channel signal CHP (FIG. 10).

3. Envelope control for controlling the tone colour and volume.

Referring again to FIG. 10, in each of the musical tone control systems for the upper and lower keyboards and the pedal key board, sample-hold circuits $SH_1$ through $SH_{15}$, voltage-controlled type filters 501 through 515 (hereinafter designated as VCF) and voltage-controlled type amplifiers (VCA) 601 through 615 are connected in series in the order mentioned and these series circuits are connected in parallel for the respective static channels. Static channel signals $CH_1$ through $CH_{17}$ of the upper keyboard are applied from the key assigner 40 to respective sampling control inputs of the sample-hold circuits $SH_1$ through $SH_7$ for the upper keyboard, thereby controlling the sampling action of corresponding sample-hold circuit $SH_1$ through $SH_7$. Similary, to the sample-hold circuits $SH_8$ through $SH_{14}$ for the lower keyboard and to the sample-hold circuit $SH_{15}$ for the pedal keyboard are respectively applied the static channel signals $CH_1'$ through $CH_7'$ and CHP of the respective keyboards. Respective static channel signals $CH_1$ through $CH_7$, $Ch_1'$ through $CH_7'$ and CHP sample the tone source signal MS for corresponding sample-hold circuits $SH_1$ through $SH_{15}$ at the time slot of signal "1" and hold the voltage (amplitude) of the signal MS at the time of sampling. Of the time shared multiplexed tone source signals MS, a time slot assigned with the tone of a given channel is made to perfectly coincide with a time slot generated by a static channel signal (either one of $CH_1$ through $CH_7$, $CH_1$ through $CH_7'$ and CHP) to which the tone was reassigned. Consequently, according to the content of the reassignement of the key assigners 40 and 50, the time shared multiplexed tone source signal MS is allocated to a predetermined one of sample-hold circuits $SH_1$ through $SH_{15}$ corresponding to the respective static channels for each tone (one channel) and held thereby. In this manner, the tone source signal MS is connected into a static state for the respective tones (for each one of 12 channels). Accordingly, the tone source signals produced by the respective sample-hold circuits $SH_1$ through $SH_{15}$ are not multiplexed signals but single continuous tone signals, respectively.

The output from the sample-hold circuits $SH_1$ through $SH_{15}$ are applied to VCF, respectively, for independently controlling the tones of the respective channels. VCF 510 through 515 operate to vary the cut-off frequency of the filter to any desired value for producing tones of a desired tone color and for varying the tone colour with time. The characteristic of the filter of each VCF may be low-pass, high-pass or band-pass according to requirement. Although not shown, it is advantageous to connect in parallel or in series a plurality of VCFs having different characteristics for one static channel for selecting any VCF having the desired characteristic depending upon the harmonic components of the tone to be generated. Since various types of circuits construction of VCF and VCA are known, it will not be necessary to show them in detail.

A sample-hold circuit may be constituted by a suitable combination of an electronic switching element such as a field-effect transistor, and a capacitor, The cut-off frequency of VCF 501 through 515 can be varied by the control voltage signal (or control voltage waveshape) generated by envelope generators $EG_1$ through $EG_{15}$ provided for each corresponding VCF.

Since it is not desirable that the colour of the generated tone is varied by the pitch thereof, it is necessary to vary the cut-off frequency of the filter of each VCF in accordance with the pitch of the tone. In the second musical tone generator 2, for the purpose of generating tones of a same irrespective of the pitches, there is provided a key memory 70 which prestore key voltages corresponding to the pitches of the respective keys and set to values that can vary the cut-off frequency of VCF 501 through 515. Since the key address signal KAD sent from the key assigner circuit 5 corresponds to the respective keys, the key voltage of a given key is read out in accordance with the key address signal KAD. The output from the key voltage memory 70 is applied to the sample-hold circuits $SH_{21}$ through $SH_{35}$ which correspond to the respective static channels thus controlling the sampling operation according to the static channel signals $CH_1$ through $CH_7$, $CH_1'$ through $CH_7'$, and CHP. Accordingly, key voltages corresponding to the tone source signals held by the respective sample-hold circuits $SH_1$ through $SH_{15}$ are held by sample hold circuits $SH_{21}$ through $SH_{35}$. These key voltages are applied to the control voltage inputs of corresponding VCF 501 through 515 for varying the cut-off frequency. In this manner, musical tones having the same colour are produced when any one of the key is depressed.

The musical tones whose tone colours have been controlled by VCF 501 through 515 are applied to VCA 601 through 615. In VCA 601 through 615, the gains of the amplifiers are varied in accordance with the waveforms of the envelope control voltages generated by envelope generators $EG_{21}$ through $EG_{35}$ provided for $VCA_{601}$ through 615, whereby the amplitudes (volume) of the musical tone signals are varied with time. The outputs from the respective VCA 601 through 607, 608 through 614 and 615 are grouped keyboard by keyboard and, after balancing of the volumes of the tones of the upper and lower keyboards, the tones of all the keyboards are mixed together by a resistor. In this manner, various tones generated by the second musical tone generators 2 are mixed.

The static channel signals $CH_1$ through $CH_7$, $CH_1'$ through $CH_7'$ and CHP, the clear signals C and C' from the key assigners 40 and 50, respectively (the counter clear signal CC is applied to generators $E_{15}$ and $EG_{35}$) and the decay start signal DS are applied to corresponding envelope generators $EG_1$ through $EG_{15}$ and $EG_{21}$ through $EG_{35}$ of the respective static channels thereby producing control voltage waveshapes for controlling the colour or volume in accordance with these input signals.

Figure 18:
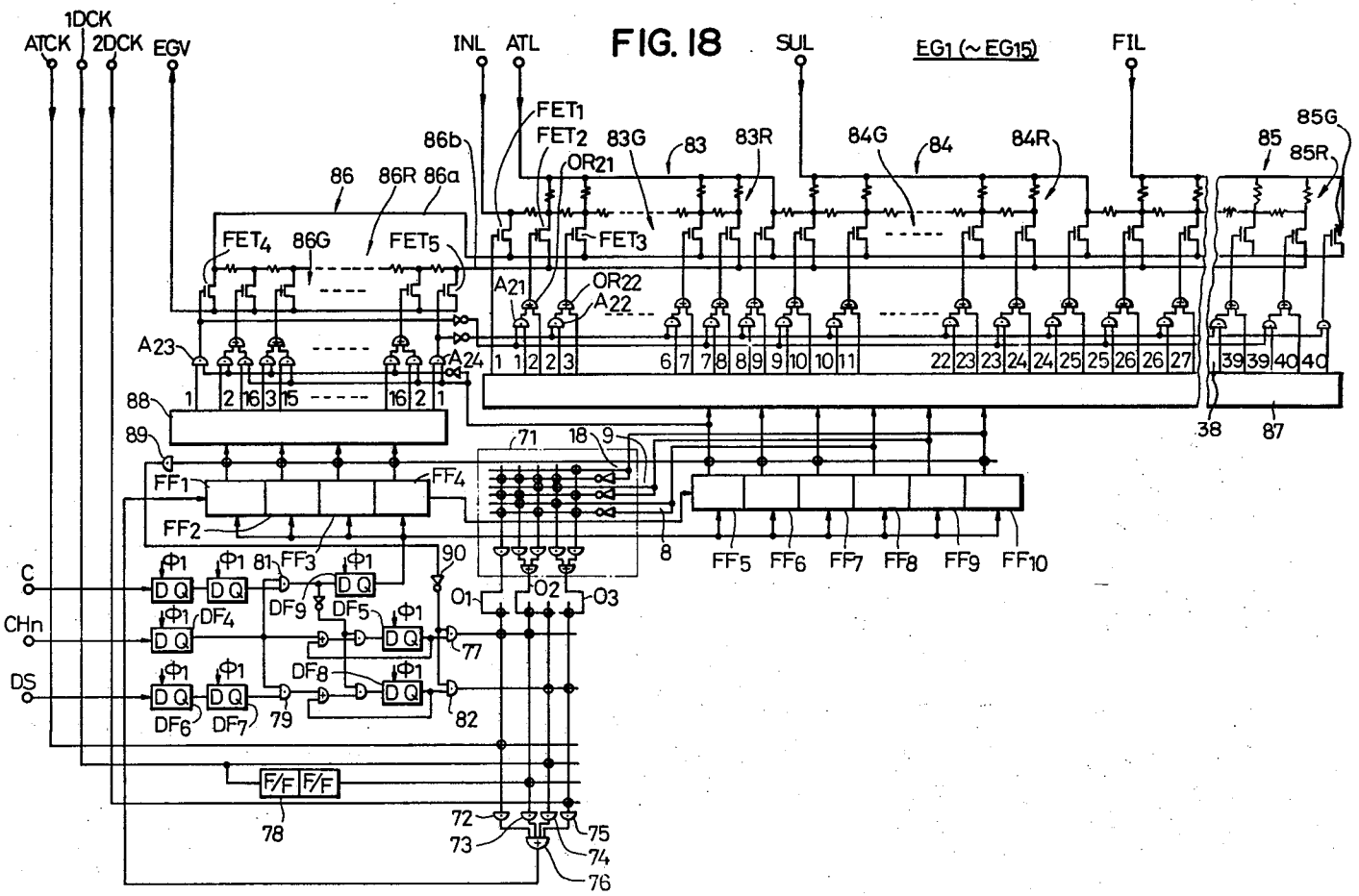
Figure 19:
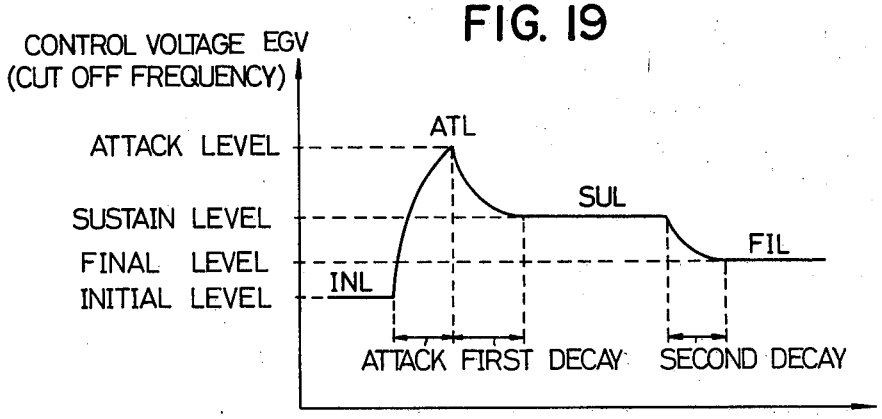

One example of the envelope generators $EG_1$ through $EG_{15}$ for VCF is shown in FIG. 18. Before describing in detail the circuit shown in FIG. 18, a typical pattern of the control voltage waveshape (envelope) to be generated will first be considered with reference to FIG. 19. In FIG. 19, the ordinate shows the value of the control voltage EGV produced by the envelope generators $EG_1$ through $EG_{15}$ which also shows the variation in the cut-off frequency of VCF whereas the abscissa represente the time. The factors that determine the control voltage waveshape are the initial level INL, the attack level ATL, the sustain level SUL, and the final level FIL of the voltage and the time in which the voltage EGV, starting from the initial level INL, successively reaches the levels ATL, SUL and FIL. The portion in which the voltage varies from the initial level INL to the attack level is defined as an attack, the portion in which the voltage varies from the attack level ATL to the sustain level SUL is termed as the first decay and the portion in which the voltage varies from the end of the sustain level SUL to the final level FIL is defined as the second decay.

In the envelope generators $EG_1$ through $EG_{15}$(FIG. 18) the waveshape of the voltage during the attack, first and second decays are shaped by the voltage divisions between respective set levels INL, ATL, SUL and FIL and interpolations. The speed of forming such divided voltages and performing the interpolations are determined by an attack clock pulce ATCK, the first decay clock pulse 1 DCK, and the second decay clock 2DCK pulse which are applied from outside. Accordingly, these clock pulses ATCK, 1DCK and 2DCK determine the attack time, the first decay time and the second decay time, respectively.

These factors, that is, the levels INL, FIL and clock pulses ATCK', 1DCK and 2DCK that determine the control voltage waveform EGV are generated by the tone colour selection circuit shown in FIG. 13 in which are provided variable oscillators 33*a* through 33*n* for the attack clock pulse ATCK, variable oscillators 34*a* through 34*n* for the first decay clock pulse 1DCK, variable oscillators 35*a* through 35*n* for the second decay clock pulse 2DCK, variable resistors 37*a* through 37*n* for the attack level ATL, variable resistors 38*a* through 38*n* for the sustain level SUL, and the variable resistors 39*a* through 39*n* for the final level FIL to correspond to respective tone colour selecting switches 30*a* through 30*n*. When certain switches 30*a* through 30*n* are selected, the clock pulses ATCK~2DCK and the levels INL FIL which are set by corresponding elements 33*a*~33*n*~39*a*~39*n* are selectively produced by the voltages of corresponding busbars 31*a* through 31*n*. As has been described above, the tone colour selecting circuits as shown in FIG. 13 are provided for the respective keyboards and the clock pulses ATCK through 2DCK and levels INL-FIL generated by the tone colour selecting circuits of the respective keyboards are applied to the envelope generators $EG_1$ through $EG_7$ (upper keyboard), $EG_8$ through $EG_{14}$ (lower keyboard) and $EG_{15}$ (pedal keyboard) corresponding to the respective keyboards.

As shown in FIG. 18, in each one of the envelope generators $EG_1$ through $EG_{15}$, 10 flip-flop circuits $FF_1$ through $FF_{10}$ are connected in series for forming a 10-stage counter. These flip-flop circuits are driven by either one of the attack clock pulse ATCK and first and second decay clock pulses 1DCK and 2DCK. Upon receiving a clock pulse, the counter is advanced one step. The contents of respective stages ($FF_1$ through $FF_{10}$) vary as shown in Table 2 at respective steps.

Table 2

| Step | 1 | 2 | 3 | 4 | 5 | 6 | 7 | 8 | 9 | 10 | ← initial level |
|---|---|---|---|---|---|---|---|---|---|---|---|

Table 2-continued

| | | | | | | | | | | | |
|---|---|---|---|---|---|---|---|---|---|---|---|
| 0 | 0 | 0 | 0 | 0 | 0 | 0 | 0 | 0 | 0 | 0 | ↑ |
| 1 | 1 | 0 | 0 | 0 | 0 | 0 | 0 | 0 | 0 | 0 | |
| | | | | | | | | | | | ↑ 128 |
| 2 | 0 | 1 | 0 | 0 | 0 | 0 | 0 | 0 | 0 | 0 | attack steps |
| 3 | 1 | 1 | 0 | 0 | 0 | 0 | 0 | 0 | 0 | 0 | ↓ |
| . | | | | | . | | | | | | |
| . | | | | | . | | | | | | ↓ |
| 126 | 0 | 1 | 1 | 1 | 1 | 1 | 1 | 0 | 0 | 0 | ↓ |
| 127 | 1 | 1 | 1 | 1 | 1 | 1 | 1 | 0 | 0 | 0 | ← last step ← attack level |
| 128 | 0 | 0 | 0 | 0 | 0 | 0 | 0 | 1 | 0 | 0 | ← of attack ↑ |
| 129 | 1 | 0 | 0 | 0 | 0 | 0 | 0 | 1 | 0 | 0 | |
| 130 | 0 | 1 | 0 | 0 | 0 | 0 | 0 | 1 | 0 | 0 | ↑ first 256 |
| . | | | | | . | | | | | | decay steps |
| . | | | | | . | | | | | | |
| 255 | 1 | 1 | 1 | 1 | 1 | 1 | 1 | 1 | 0 | 0 | |
| 256 | 0 | 0 | 0 | 0 | 0 | 0 | 0 | 0 | 1 | 0 | ↑ |
| 257 | 1 | 0 | 0 | 0 | 0 | 0 | 0 | 0 | 1 | 0 | |
| 258 | 0 | 1 | 0 | 0 | 0 | 0 | 0 | 0 | 1 | 0 | ↑ |
| 259 | 1 | 1 | 0 | 0 | 0 | 0 | 0 | 0 | 1 | 0 | |
| . | | | | | . | | | | | | ↓ |
| . | | | | | . | | | | | | |
| 382 | 0 | 1 | 1 | 1 | 1 | 1 | 1 | 0 | 1 | 0 | ↓ |
| 383 | 1 | 1 | 1 | 1 | 1 | 1 | 1 | 0 | 1 | 0 | ← last step of first decay sustain level |
| 384 | 0 | 0 | 0 | 0 | 0 | 0 | 0 | 1 | 1 | 0 | ← sustain state ↑ |
| 385 | 1 | 0 | 0 | 0 | 0 | 0 | 0 | 1 | 1 | 0 | |
| 386 | 0 | 1 | 0 | 0 | 0 | 0 | 0 | 1 | 1 | 0 | ↑ |
| . | | | | | . | | | | | | |
| . | | | | | . | | | | | | ↑ second 256 |
| 510 | 0 | 1 | 1 | 1 | 1 | 1 | 1 | 1 | 1 | 0 | decay steps |
| 511 | 1 | 1 | 1 | 1 | 1 | 1 | 1 | 1 | 1 | 0 | |
| 512 | 0 | 0 | 0 | 0 | 0 | 0 | 0 | 0 | 0 | 1 | ↓ |
| 513 | 1 | 0 | 0 | 0 | 0 | 0 | 0 | 0 | 0 | 1 | |
| . | | | | | . | | | | | | ↓ |
| . | | | | | . | | | | | | |
| 636 | 0 | 0 | 1 | 1 | 1 | 1 | 1 | 0 | 0 | 1 | ↓ |
| 637 | 1 | 0 | 1 | 1 | 1 | 1 | 1 | 0 | 0 | 1 | |
| 638 | 0 | 1 | 1 | 1 | 1 | 1 | 1 | 0 | 0 | 1 | ↓ |
| 639 | 1 | 1 | 1 | 1 | 1 | 1 | 1 | 0 | 0 | 1 | ← last step of second decay ← final level |

Thus, 128 steps are allocated to the attack and 256 steps for the first and second decays, respectively. As can be clearly noted from Table 2, by examining the outputs of flip-flop circuits $FF_8$, $FF_9$ and $FF_{10}$ of the three upper order bits, it can be readily known whether the operation is at the attack, the first decay or the second decay. For this purpose, outputs of these flip-flop circuits are applied to a matrix circuit 71 which produces an output $\mathbf{0}_1$ of the state "1" when three inputs ($FF_8$, $FF_9$ and $FF_9$) are "000" representing an attack, and the output $\mathbf{0}_2$ of the state "1" where the three bits are "100" or "010" representing the first decay. On the other hand, when the three bits are "110" or "001", the output $\mathbf{0}_3$ becomes "1" state representing the second decay. The output $O_1$ is coupled to an AND circuit 72 for selecting the attack clock pulse ATCK. The output $O_2$ is applied to AND circuits 73 and 74 for selecting the first decay clock pulse LDCK whereas the output $O_3$ is applied to AND gate circuit 75 for selecting the second decay clock pulse 2DCK. The outputs of the AND circuits 72 through 75 are applied to the inputs of OR circuit 76 and the output thereof is applied to the flip-flop circuit $FF_1$, comprising the first bit of said counter. Thus, any one of the clock (ATCK, 1DCK and 2DCK) selected in this manner is applied to the flip-flop circuit $FF_1$ via the OR circuit 76 for driving the counter comprising 10 flip-flop circuits $FF_1$ through $FF_{10}$, whereby the operating speed of the counter is determined by the clock pulses. The signal $CH_n$ (any one of $CH_1$ through $CH_7$, $CH_1'$ through $CH_7'$ and CHP) of a corresponding static channel is applied to the envelope generators ($EG_1$ through $EG_{15}$) and the signal is delayed by one main clock pulse $\phi_1$ by the delay flip-flop circuit $DF_4$ and stored in the delay flip-flop circuit $DF_5$. The signal "1" stored in this flip-flop circuit $DF_5$ is applied to the AND circuits 72 and 73 via AND circuit 77. Accordingly, when a key is depressed, AND circuit 72 is enabled to apply the attack clock pulse ATCK to the counter comprising ten flip-flop circuits $FF_1$ through $FF_{10}$.

The frequency of the first decay clock pulse is reduced by a ¼ frequency divider 78 and then applied to AND circuit 73. The first decay clock signal is also applied to AND circuit 74 without dividing its frequency. Usually, when the first decay pulse is applied, AND circuit 73 is enabled to send out a slower clock pulse as the first decay clock pulse. However, when the key is released during the first decay pulse the dacy start signal DS is produced, and the AND circuit 74 is enabled to terminate the remaining portion of the first decay pulse at a high speed.

The decay start signal DS is delayed by two clock pulses ($\frac{1}{81}$) by delay flip-flop circuits $DF_6$ and $DF_7$ so as to cause AND circuit 79 to select only a signal in synchronism with a given static channel signal $CH_n$ and the selected signal is stored in the delay flip-flop circuit $DF_8$. Since the signal DS is multiplexed in time sharing, AND circuit 79 selects signals only in the same channel time. Similarly, the clear signal C is also delayed by two clock pulses and then selected by AND circuit 81. While the clear signal C is sent from the key assignor 40, in the case of the lower keyboard, clear signal C' is produced, whereas in the case of the pedal keyboard, signal CC is utilized. Since signal $CH_n$ is delayed one clock pulse by key assigners 40 and 50 (flip-flop 60) in this case signals C and DS are delayed by two clock pulses for obtaining synchronism. The decay start signal stored in flip-flop circuit $DF_8$ is applied to the AND circuits 74 and 75 via AND circuit 82. Accordingly, during the first decay, AND circuit 74 is enabled whereas during the sustain (second decay) AND circuit 75 is enabled. In this manner, the clock pulses for driving the counter, that is flip-flop circuits $FF_1$ through $FF_{10}$, are determined. If a tone is assigned to a given static channel, clear signal C will be applied to the reset terminals of respective flip-flop circuits $FF_1$ through $FF_{10}$ from delay flip-flop circuit $DF_9$ for resetting them.

Figure 20:
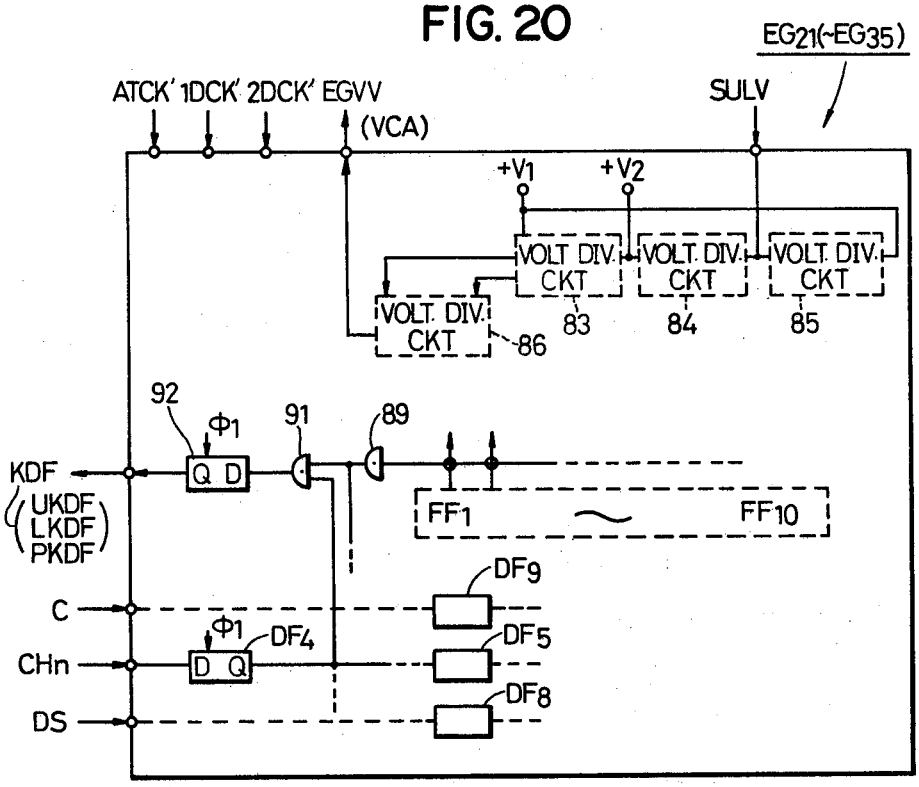

For the purpose of producing waveforms of the attack, the first decay and the second decay as shown in FIG. 19 there are provided a plurality of voltage dividing circuits 83, 84 and 85 as shown n FIG. 20 which comprise a plurality of registors 83R through 85R which are set to provide desired curves and a plurality of analog gate circuits 83G through 85G (in the drawing shown as FET) connected to respective taps of the voltage dividing circuits. Across the voltage dividing circuit 83 are impressed, for producing the attack curve, the voltages representing the initial level INL and the attack level ATL thereby providing divided voltages. In the same manner, the voltages representing the attack level ATL and the sustain level SUL are impressed across the voltage dividing circuit 84 to provide the first decay curve, and the voltages representing the sustain level SUL and the final level FIL are impressed across the voltage dividing circuit 85 to provide the second decay curve.

Voltage dividing circuits 83 through 85 divide the attack into 8 sections, the first decay into 16 sections and the second decay into 16 section, thus forming a total of 40 sections. The circuit is constructed such that the data of the higher 6 bits of the counter (flip-flops $FF_5$ through $FF_{10}$) are decoded by decoder 87 for producing 40 outputs corresponding to decimal numerals of 0 through 39, which are used to drive the analog gate circuits 83G through 85G of the voltage dividing circuits 83, 84 and 85. Although curves approximating the attack, and the first and second decays can be obtained by the sequential driving of the analog gate circuits 83G through 85G, since the number of division is small, the curves obtained have noticeable steps. This results in giving an unnatural feeling to the audience so that a second voltage dividing circuit 86 is used for providing an interpolation to obtain smooth waveforms.

The voltage dividing circuit 86 for providing the interpolation is constituted by serially connected resistors 86R and respectively provided analogs gate circuits 86G for deriving divided voltages. The divided voltages from the voltage dividing circuits 83, 84 and 85 are applied, one after another, across the voltage dividing circuit 86 which is used to divide the voltage into 16 smaller sections for the interpolation. Accordingly, the lower 4 bit outputs from the flip-flop circuits $FF_1$ through $FF_4$ of the counter are decoded by decoder 88 into 16 signals which are used to sequentially drive the analog gate circuits 86G of the voltage dividing circuit 86.

The voltage dividing circuits 83, 84 and 85 must supply voltages of two adjacent division points to the voltage dividing circuit 86. Accordingly, AND and OR circuits are suitably arranged such that one output signal from the decoder 87 can simultaneously drive two analog gate circuits adapted to derive out voltages of two adjacent division points on the voltage dividing circuits 83, 84 and 85. For example, an output having a value 1 of the decoder 87 is used to drive one analog gate circuit $FET_1$ and also to drive adjacent analog gate circuit $FET_2$ via AND circuit $A_{21}$ and OR circuit $OR_{21}$. The output from the analog gate circuit $FET_1$ is applied to the input **86*a* of the voltage dividing circuit 86, whereas the output of the analog gate circuit $FET_2$ is applied to the input 86*b* of the voltage dividing circuit 86. The voltage applied to input line 86*a* at this time is generated at an earlier step than the voltage applied to input line 86*b*. An output having a value 2 of the decoder 87 is used to drive the analog gate circuit $FET_2$ via OR circuit $OR_{21}$ and to drive the analog gate circuit $FET_3$ via AND circuit $A_{22}$ and OR circuit $OR_{22}$. The output from the analog gate circuit $FET_3$ is coupled to the input line 86*a***.

The order of the steps of the voltages applied to the input lines **86*a* and 86*b* of the voltages dividing circuit 86 is not always definite but alternates. In the above described case, for example, at the time when the analog gate circuits $FET_2$ and $FET_3$ are driven, the voltage on input line 86*a* is generated at a later step than the voltage on the input line 86*b*. More particularly, each time the state of the flip-flop circuit $FF_5$ is reversed, the order of the steps of the input lines 86*a* and 86*b* is reversed so that the output signal and its inversion of the flip-flop circuit $FF_5$ are applied to suitable AND circuits provided on the output side of the decoder 88 so as to sequentially derive out the outputs of the voltage dividing circuit 86 through input line 86*a* when the output of the flip-flop circuit $FF_5$ is "0", whereas, when this output is "1", to sequentially derive out the outputs of the voltage dividing circuit 86 through the output line 86*b*. For example, an output having a value 1 of the decoder 88 is applied to the inputs of AND circuits $A_{23}$ and $A_{24}$. To the other input of AND circuit $A_{23}$ is supplied the inverted output of the flip-flop circuit $FF_5$ whereas the other input of AND circuit $A_{24}$ is connected to receive the output (not inverted) of the flip-flop circuit $FF_5$. AND circuit $A_{23}$ is connected to drive the analog gate circuit $FET_4$ on the side of the input line 86*a*, whereas AND circuit $A_{24}$ is connected to drive the analog gate circuit $FET_5$ on the side of the input line 86*b*. Consequently, in the first step C (steps 0 – 15 shown in Table 2) of the decoder 87, the analog gate circuit $FET_4$ is driven by the output from AND circuit $A_{23}$ for sequentially deriving out the fractional voltage through the input line 86*a* but in the next step (steps 16 – 31 in table 2) the divided voltages are sequentially readout through input line 86*b*. Thereafter, the direction of reading alternates in the same manners. In the first step (value 1) of the decoder 88, the voltage from the first voltage dividing circuits 83, 84 and 85 is read out from the voltage dividing circuit 86 without any change so that the voltage is supplied to only one of the input lines 86*a* and 86*b***. Accordingly, the inventions of the output from AND circuits $A_{23}$ and $A_{24}$ are applied to the inputs of AND circuits $A_{21}$, $A_{22}$ . . . for disenabling the same.

The output from the second voltage dividing circuit 86 is applied to the control input of the VCF (501 – 515) to act as the control voltage waveshape EGV.

When the step 639 shown in Table 2 is reached, the code of this step is detected by AND circuit 89. The output signal "1" from AND circuit 89 is inverted by inverter 90 to disenable the AND circuits 77 aand 82. Accordingly, AND circuits 72 through 75 are disenabled to prevent supply of the second decay clock pulse 2DCK, whereby the counter (flip-flop circuits $FF_1$ through $FF_{10}$) remains at step 639 to hold the final level FIL.

The construction and operation of the envelope generators $EG_{21}$ through $EG_{35}$ for VCA are as follows:

Since the envelope generators $EG_1$ through $EG_{35}$ are substantially the same as the envelope generators $EG_1$ through $EG_{15}$ for VCF, only some difference will be described.

Although the control voltage waveshape EGVV has substantially the same pattern as that of the control voltage waveshape EGV shown in FIG. 19, the initial level and the final level are equal and fixed to a constant voltage $+V_1$. The attack level is also fixed to a constant voltage $+V_2$, and only the sustain level is made variable. Consequently, only the sustain level voltage SULV as shown in FIG. 20 is applied from outside. Furthermore, the attack clock pulse ATCK', the first decay clock pulse 1DCK' and the second decay clock pulse 2DCK' are different from the clock pulses utilized for VCF. The level SULV, and clock pulses ATCK', 2DCK' are set to any desired values by the attack variable oscillators 91*a* through 91*n* of the tone colour selection circuit shown in FIG. 13, the first decay variable oscillators 92*a* through 92*n*, the second decay variable oscillators 93*a* through 93*n*, and the variable resistors 94*a* through 94*n* for setting the sustain levels, and are selected by the tone colour selection switches 30*a* through 30*n*.

In FIG. 20, the construction of the envelope generators $EG_{21}$ through $EG_{35}$ contained in a block is substantially the same as that shown in FIG. 18 except those depicted by solid lines. For this reason, elements having the same function as those shown in FIG. 18 are designated by the same symbols. It should be understood, however, that the same elements are used in both FIGS. 18 and 20. Elements not shown in FIG. 20 should be referred to FIG. 18.

As has been described in connection with the key assinger 40 (FIG. 14), the envelope generators $EG_{21}$ through $EG_{33}$ are constructed to generate a static-channel decay finish signals KDF which represent that the tone generation of given static channels have been completed. Termination of the tone generation means that the control voltage waveshape for VCA has reached the final level, or that the counter comprising flip-flop circuits $FF_1$ through $FF_{10}$ has reached step 639. These conditions are detected by AND circuit 89, and when this AND circuit produces a "1" signal, the tone generation is terminated. This output from AND circuit 89 is applied to one input of AND circuit 91 while a signal $CH_n$ of the given static channel delayed 1 clock pulse ($o_1$) by the delay flip-flop circuit $DF_4$ is applied to the other input of AND circuit 91. AND circuit 91 produces an output in a time slot (channel time) of the tone assigned to the given static channel, and this output is delayed colck pulse ($o_1$) by the delay flip-flop circuit 92 for synchronizing it with the outputs of other delay flip-flop circuits $DF_9$, $DF_5$ and $DF_8$. The output from the flip-flop circuit 92 is applied to the OR circuit 69 (FIG. 14) of the key assigner 40 to act as the decay finish signal KDF for the given static channel.

As has been described in detail, the second musical tone generator 2 can generate musical tones whose tone colours and volumes (amplitudes) can be varied at will with time.

In addition to the first and second musical tone generators 1 and 2, it is also possible to provide additional musical tone generating apparatus which is operated by a signal from the key assigner circuit 5. The construction of the key assigner circuit 5 is not limited to that shown in FIG. 4 so that it is possible to use any circuit in this invention provided that it can digitally process the information of the tone designated by depression of a key and distribute the processed information among respective musical tone generators.

What is claimed is:

1. An electronic musical instrument comprising:

keys; key switches respectively actuated by said keys;

depressed key detection means for producing key identification information identifying each depressed key in a time shared fashion;

key assigner means for assigning each different key identification information to a respective one of plural channels defined by channel-associated successive time slots for producing, in a time shared fashion, key address codes corresponding to each depressed key and key information representing whether the corresponding key still is being depressed or has been released;

frequency information means, connected to said key assigner means, for generating in said time shared fashion frequency information corresponding to each assigned key address code;

a first musical tone generation system, connected to said frequency information means and responsive to said frequency information, for producing a first musical tone waveshape including a plurality of waveshape memories storing, by chronologically sampled wave values, a fundamental wave and a plurality of separate harmonic waves respectively, an envelope memory storing an envelope shape by chronologically sampled amplitude values, a first reading circuit for reading sample points of all of said waveshape memories at a rate determined by said frequency information, harmonic coefficient means for establishing the relative levels of the fundamental wave and each separate harmonic wave read from said waveshape memories and for combining these waves of adjusted relative value to obtain said first musical tone waveshape, a second reading circuit for reading sample points of said envelope memory at a predetermined rate in response to the key information provided by said key assigner means, and envelope imparting means for controlling the entire level of said waves read from said waveshape memories in accordance with the sampled amplitude values read from said envelope memory;

a second musical tone generation system, also connected to said frequency information means and responsive to said frequency information, for producing a second musical tone waveshape which changes in its tone colour and volume with the lapse of time, including at least one tone source waveshape memory storing, by chronologically sampled wave values, a tone source waveshape containing abundant harmonic components, a reading circuit for reading sample points of said tone source waveshape memory at a rate determined by said frequency information, a plurality of tone colour and volume control systems for applying desired tone colour and volume controls to said read out tone source waveshape, and distributing means for distributing the tone source waveshapes read in time shared fashion from said tone source waveshape memory to said tone colour and volume control systems; and an audio system, connected to the outputs of said first and second musical tone generation systems, for reproducing both said first and second musical tones.

2. An electronic musical instrument as defined in claim 1 which comprises at least two systems of said first musical tone generation system and further comprises a circuit for making frequency information to be applied to the respective systems slightly different from each other thereby to produce simultaneously waveshapes of two musical tones which are different in pitch from each other with respect to each of the key or keys being depressed.

3. An electronic musical instrument as defined in claim 1 wherein said distributing means comprises a key reassigner, operative upon receipt of said key information, for enabling one of said tone colour and volume control systems and for distributing the tone source waveshape read in the corresponding time slot from said tone source waveshape memory to the respective enabled tone colour and volume control system.

4. An electronic musical instrument as defined in claim 1 wherein said reading circuit in said second musical tone generation system comprises means for generating information representing constants corresponding to musical tone frequency of the depressed key in accordance with respective key address codes provided in a time shared fashion by said key assigner means and a cumulative counter for sequentially and cumulatively adding the constants every predetermined period of time, the sample point amplitudes of the waveshape stored in said tone source waveshape memory being sequentially read out in a time shared fashion in accordance with the output of said cumulative counter.

5. An electronic musical instrument as defined in claim 1 wherein said harmonic coefficient means comprises a harmonic coefficient memory effectively storing coefficients for adjusting levels of the respective harmonics.

6. An electronic musical instrument as defined in claim 5 wherein said harmonic coefficient memory includes sets of coefficients, each set being defferent from other set depending upon the kind of the keyboard, and comprises a gate which gate out, in accordance with data included in said key address code and representing the kind of keyboard, one of said sets of coefficients corresponding to the keyboard represented by said data.

7. An electronic musical instrument as defined in claim 1 wherein the tone colour and volume control system is provided for each of a desired number of static channels assigned to the respective keyboards and the system comprises a first sample and hold circuit for sampling and holding the output of said tone source waveshape memory, a voltage-controlled type filter receiving the signal held by said first sample and hold circuit, a voltage-controlled type amplifier receiving the output of said voltage-controlled type filter, a second sample and hold circuit for sampling and holding voltage corresponding to the key and thereby causing the cut-off frequency of said voltage-controlled type filter to vary in accordance with the key, a first envelope generator storing a predetermined envelope waveshape and causing the filter characteristics of said voltage-controlled type filter to vary in accordance with said envelope waveshape and a second envelope generator storing a predetermined envelope waveshape and causing amplification degree of said voltage-controlled type amplifier to vary in accordance with said envelope waveshape stored in said second envelope generator.

8. An electronic musical instrument as defined in claim 6 wherein each of said first and second envelope generators comprises a first voltage dividing circuit having a plurality of voltage division points between two inputs where two different kinds of voltages are separately applied, a first circuit for deriving voltage divided outputs from two adjacent division points among said plurality of division points, a second voltage dividing circuit having a plurality of voltage division points which further divide the output voltages derived out by said first circuit and a second circuit for sequentially deriving voltage divided outputs from the respective voltage division points of said second voltage dividing circuit, said first circuit sequentially shifting the voltage division points in said first voltage dividing circuit from which outputs should be derived out every time said second circuit completes deriving of outputs from all of the division points of said second voltage dividing circuit.

9. An electronic musical instrument comprising:

keys;

key identification information generation means responsive to said keys for generating key identification and information; and a plurality of musical tone generation systems producing tone signals in a different way from each other according to the same key identification information from said key identification information generation means, wherein one of said tone generation systems includes:

a Fourier synthesis tone generator, responsive to said key identification information, for producing tone signals by combining the sampled amplitudes of individual harmonic constituents each weighted in relative amplitude by a harmonic coefficient for that constituent, and wherein another of said tone generation systems includes:

a frequency attenuation tone generator having a first means for repetitively producing by consecutively sampled amplitudes a waveshape having abundant harmonics, and controllable filter means for selectively attenuating from said abundant harmonic waveshape the frequency components within a certain frequency band, said instrument further comprising:

means for providing both said harmonic constituent sampled amplitudes and said abundant harmonic waveshape sampled amplitudes at a common rate established by said key identification information so tht both tone generators produce the same note but with different tonal qualities.

10. An electronic musical instrument according to claim 9 wherein:

said Fourier synthesis tone generator includes a plurality of waveshape memories each containing the sampled amplitudes of a sinusoidal waveshape, the sinusoidal waveshapes in different memories being harmonically related, wherein:

said frequency attenuation tone generator includes at least one memory storing the sampled amplitudes of said waveshape having abundant harmonic components, and wherein:

said sampled amplitude providing means comprises a frequency information memory, cooperating with said key identification information generating means, for providing a phase angle number corresponding to each key identification information, said number specifying the phase angle between successive sample points accessed from each memory, and a counter for accumulating the phase angle numbers provided from said frequency information memory at a constant clock rate to provide successive sample point addresses for accessing each waveshape memory.

11. A polyphonic musical tone generation system comprising:

a plurality of key switches, time-shared key assigner means for assigning to a respective time slot, in a repetitive set of such time slots, a key address code corresponding to each actuated key switch, a waveshape memory storing the sampled amplitudes of a tone source waveshape having abundant harmonic components, a memory access circuit for accessing a sampled amplitude from said waveshape memory upon occurrence of each time slot for which a key address code is assigned, the effective phase angle between successive sample points read from said memory during consecutive occurrences of a like time slot being established by the address code assigned to that time slot, so that for consecutive like time slots, the tone source waveshape will be read out at a fundamental frequency corresponding to said actuated key switch, a plurality of tone color modification circuits, said plurality being equal to the number of time slots in said set, a modification circuit assigner for assigning a respective one of said tone color modification circuits to each particular time slot to which a key address code has been assigned, each such modification circuit comprising:

a sample and hold circuit for holding each amplitude sample accessed from said waveshape memory during the corresponding particular time slot until occurrence of the next amplitude sample during the same particular time slot in the next repetitive set of time slots, a voltage controlled filter connected to filter the waveshape defined by the consecutive sampled amplitudes held in the sample and hold circuit in that modification circuit, said voltage controlled filter being controllable in response to a time-variant control voltage so as to attenuate selectively certain frequency components, and hence modify the tone color of said defined waveshape, and means for combining the outputs of all said plurality of tone color modification circuits to produce a musical tone.

12. A musical tone generation circuit according to claim 11 wherein:

said key assigner means also includes circuitry for assigning to the same respective time slot key information representing whether the corresponding key switch is actuated or has been released, and wherein each modification circuit includes an envelope generator, responsive to the key information for the time slot to which that modification circuit has been assigned, for generating a time variant control voltage for the voltage controlled filter in the same modification circuit, time variation of said control voltage being initiatable both by actuation and release of said corresponding key switch.

13. A musical tone geneation system according to claim 11 together with:

a second waveshape memory storing a like tone source waveshape having abundant harmonic components, a second like memory access circuit for accessing sampled amplitudes from said second waveshape memory, a frequency information means, responsive to said key assigner means, for providing a phase angle number corresponding to each assigned key address code, each such phase angle number establishing the phase angle between consecutive sampled amplitudes for the fundamental frequency of the corresponding actuated key switch, a frequency offset means for modifying each phase angle number to obtain two separate phase angle numbers slightly different in value, said separate phase angle numbers being provided respectively to said two waveshape memories so as to access therefrom, during successive like time slots, respective first and second tone source waveshapes having slightly different fundamental frequencies, and means for combining the amplitude samples accessed from said two waveshape memories during each particular time slot for input to the tone color modification circuit assigned to that particular time slot.

14. An electronic musical instrument comprising:

first and second identical tone generators each of the type wherein a musical note is generated by successively accessing from at least one waveshape memory the sampled amplitudes of a waveshape stored in said waveshape memory, said accessing being carried out at a successive sample point separation established by a phase angle number corresponding to a selected note, a frequency information memory storing a set of phase angle numbers for notes of a musical scale, each of said stored phase angle numbers corresponding to a pitch which is different from the nominal true pitch of the corresponding note by a constant number of cents, a constant cent pitch difference memory storing pairs of pitch difference designation values corresponding to selectable pitch differences, first and second multiplier circuits for multiplying a selected stored phase angle number, accessed from said frequency information memory, by respective ones of a selected pair of pitch difference designation values accessed from said pitch difference memory, first and second memory access means, respectively receiving the two resultant modified phase angle numbers from said first and second multiplier circuits, for accessing sampled amplitudes from the waveshape memories in said first and second tone generators respectively in accordance with the different, resultant modified phase angle numbers, so that said two tone generators produce tones slightly separated in pitch from one another by a constant number of cents, and means for combining the outputs of said two tone generators.

15. An electronic musical instrument according to claim 14 wherein said pitch difference memory stores, for each selectable pitch difference, a pair of pitch difference designation values which produce from said multiplier circuits two resultant modified phase angle numbers that correspond respectively to fundamental frequencies that are respectively below and above the true equally tempered pitch of said selected note by the same selected pitch difference.

16. An electronic musical instrument according to claim 14 wherein each stored phase angle number corresponds to a pitch that is a fixed number of cents below the nominal true pitch of the corresponding pitch, and wherein for a selected pitch difference corresponding to said fixed number of cents, one of the stored pair of pitch difference designation values is unity, all of the other stored pitch difference designation values being greater than one.

* * * * *